US007847770B2

(12) United States Patent
Nose

(10) Patent No.: US 7,847,770 B2
(45) Date of Patent: Dec. 7, 2010

(54) METHOD OF DRIVING LIQUID CRYSTAL DISPLAY ELEMENT

(75) Inventor: Masaki Nose, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 717 days.

(21) Appl. No.: 11/861,604

(22) Filed: Sep. 26, 2007

(65) Prior Publication Data

US 2008/0024412 A1 Jan. 31, 2008

Related U.S. Application Data

(63) Continuation of application No. PCT/JP2005/005777, filed on Mar. 28, 2005.

(51) Int. Cl.
*G09G 3/36* (2006.01)

(52) U.S. Cl. ..... 345/87; 345/99

(58) Field of Classification Search ..... 345/87–102, 345/204

See application file for complete search history.

(56) References Cited

U.S. PATENT DOCUMENTS

| | | | | |
|---|---|---|---|---|
| 6,909,413 | B2 * | 6/2005 | Nanno et al. | 345/87 |
| 6,933,918 | B1 * | 8/2005 | Park et al. | 345/102 |
| 7,495,646 | B2 * | 2/2009 | Kawabe et al. | 345/95 |
| 2001/0038373 | A1 | 11/2001 | Yamakawa et al. | |
| 2005/0206596 | A1 * | 9/2005 | Chen et al. | 345/87 |
| 2006/0262248 | A1 * | 11/2006 | Burberry et al. | 349/86 |
| 2007/0002003 | A1 * | 1/2007 | Kim | 345/102 |
| 2007/0085794 | A1 * | 4/2007 | Kawabe et al. | 345/89 |

FOREIGN PATENT DOCUMENTS

| | | | |
|---|---|---|---|
| JP | 20002869 | A | 1/2000 |
| JP | 2001228459 | A | 8/2001 |
| JP | 2001281632 | A | 10/2001 |
| JP | 2002-14323 | A | 1/2002 |
| JP | 2003228045 | A | 8/2003 |
| JP | 2004309622 | A | 11/2004 |

(Continued)

OTHER PUBLICATIONS

Korean Office Action dated Sep. 9, 2008, issued in corresponding Korean Patent Application No. 10-2007-7022073.

(Continued)

*Primary Examiner*—Nitin Patel
(74) *Attorney, Agent, or Firm*—Westerman, Hattori, Daniels & Adrian, LLP

(57) ABSTRACT

In order to realize a display with a multilevel halftone that is excellent in uniformity by using a liquid crystal display element employing an inexpensive and general purpose driver having a low voltage endurance, a pulse application employing a cumulative response (overwriting) of liquid crystals is performed a plurality of times, the driving voltage and the pulse width are set to be variable for each step, and the liquid crystals are controlled to be in a prescribed halftone state by using a region having a large margin from a reflection state as the initial state. Since an increase in drive voltage is prevented, an inexpensive binary output general purpose driver having a low voltage endurance can be used. Furthermore, a display with a multilevel halftone that is excellent in uniformity is realized because of a gray level conversion that uses a region having a large margin.

20 Claims, 24 Drawing Sheets

FOREIGN PATENT DOCUMENTS

KR 2003-0068638 A 8/2003

OTHER PUBLICATIONS

Nam-Seok Lee et al., "A Novel Dynamic Drive Scheme For Reflective Cholesteric Displays"; SID 02 Digest, P-89, 2002, pp. 546-548.

Y.-M. Zhu et al., "Cumulative Drive Schemes for Bistable Reflective Cholesteric LCDs"; SID 98 Digest, P-82, 1998, pp. 798-801.

International Search Report of PCT/JP2005/005777, date of mailing Jun. 21, 2005.

* cited by examiner

METHOD OF DRIVING LIQUID CRYSTAL DISPLAY ELEMENT

CROSS REFERENCE TO RELATED APPLICATION

This application is a continuation of international PCT application No. PCT/JP2005/005777 filed on Mar. 28, 2005.

BACKGROUND OF THE INVENTION

1. Field of the Invention

The present invention relates to a method of driving a display element that uses cholesteric liquid crystals, and particularly to a method of driving a display element by which a high-quality display with a multilevel halftone is realized.

2. Description of the Related Art

In recent years, electronic paper has been vigorously developed by companies and universities. Electronic paper can be applied to various portable devices including electronic books, sub-displays in mobile terminals, and display units in IC cards.

One effective way to realize electronic paper is to utilize cholesteric liquid crystals.

A cholesteric liquid crystal has excellent characteristics, including an ability to hold a display state semi-permanently (image memory characteristic) and to display images clearly in full color at a high contrast and at a high resolution. The cholesteric liquid crystal is also called a chiral nematic liquid crystal because the cholesteric liquid crystal is a nematic liquid crystal whose cholesteric phase is formed, and the cholesteric phase where molecules of the nematic liquid crystal are tied up in a helix is formed by adding a relatively large quantity (several tens of percent) of chiral addition (also called chiral material) to the nematic liquid crystal.

Hereinafter, the principles of the display and of the driving of cholesteric liquid crystals are explained.

A display using cholesteric liquid crystals is controlled in accordance with the oriented state of the molecules in the cholesteric liquid crystals. As shown in the graph of a reflectance in FIG. 1A, cholesteric liquid crystal shave a planar (P) state, where the incident light is reflected, and a focal conic (FC) state, where the incident light penetrates, and these states are stable even without an electric field. In the planar state, light having a wavelength corresponding to the helical pitch over the liquid crystal molecules is reflected. The wavelength $\lambda$ that causes the maximum reflection is expressed by the equation below in which n is an average refraction index, and p is a helical pitch.

$$\lambda = n \cdot p$$

In contrast, the reflection band $\Delta\lambda$ increases as the refraction index anisotropy $\Delta n$ increases.

Accordingly, by suitably selecting the average refraction index n and helical pitch p, it is possible to display a color having the wavelength $\lambda$ in the planar state.

Also, by providing a light absorption layer separately from a liquid crystal layer, black can be displayed in the focal conic state.

Next, an example of driving cholesteric liquid crystals is explained.

When an intense electric field is applied to a cholesteric liquid crystal, the helical structure of the liquid crystal molecules are unwound completely and their state becomes homeotropic, with all the molecules oriented along the direction of the electric field. Next, when the electric field that has caused the homeotropic state suddenly becomes zero, the helical axis of the liquid crystal becomes perpendicular to the electrode, and the planar state is caused in which light is selectively reflected in accordance with the helical pitch. In contrast, when an electric field that is sufficiently weak so as not to unwind the helical structure is removed, or when an intense electric field is gradually removed after being applied, the helical axis of the liquid crystal becomes parallel to the electrode, and the focal conic state is caused in which the incident light penetrates. Also, when an intermediately intense electric field is applied and this electric field is removed suddenly, both the planar state and the focal conic state are caused and a display of halftones is possible.

By using this phenomenon, information is displayed.

The above voltage response characteristic can be described as follows by referring to FIG. 1A.

If the initial state is the planar state (P) (as indicated by the solid line), the driving band to the focal conic state (FC) is achieved when the pulse voltage increases to a certain range, and the driving band to the planar state is again achieved when the pulse voltage further increases.

If the initial state is the focal conic state (as indicated by the dashed line), the driving band to the planar state is gradually achieved as the pulse voltage increases.

When the voltages that are indicated in the zones of halftone zone A and halftone zone B are applied, a display of halftones is realized in which the above planar state and focal conic state are both caused.

Also, as shown in FIG. 1B, the cholesteric liquid crystals have the characteristic of a cumulative response, i.e., the cholesteric liquid crystals transit, with weak pulses being applied a plurality of times, from the planar state into the focal conic state, and from the focal conic state into the planar state.

If, for example, the initial state is the planar state, by successively applying a weak voltage pulse within the halftone zone A, the state gradually transits into the focal conic state in accordance with the number of times the pulse is applied, as shown in FIG. 1B. In contrast, as shown in FIG. 1B, when a weak voltage pulse within the halftone zone B is successively applied, the state gradually transits into the planar state in accordance with the number of times the pulse is applied regardless of which state the initial state was. This phenomenon indicates that a display at a desired halftone level can be realized by selecting the number of times to apply a pulse. Also, as shown enlarged in FIG. 1C, by gradually reducing the scatter reflections in the focal conic state, black can be displayed in a better state.

Next, by referring to FIG. 1D, electrodes that drive liquid crystals in a matrix liquid crystal display element are explained. Generally, a liquid crystal display element includes, as shown in FIG. 1D, a plurality of scanning electrodes 16 and a plurality of data electrodes 18 facing one another being arranged in such a manner that the scanning electrodes 16 cross the data electrodes 18. The spots at which the scanning electrodes 16 cross the data electrodes 18 serve as pixels. A scanning electrode driver 12 sequentially selects (common mode) one of the scanning electrodes 16, pulse voltage is applied to it, and pulse voltages corresponding to the display states of the respective pixels are applied to the data electrodes 18 by a data electrode driver 14 (segment mode); thereby, the liquid crystals of the corresponding pixels are driven. The difference between the voltage applied to the data electrodes 18 and the voltage applied to the scanning electrodes 16 is the voltage that is applied to liquid crystals of the pixels, and is the voltage that drives the liquid crystals shown in FIG. 1A.

Hereinafter, well-known prior art about methods of driving cholesteric liquid crystals with a multilevel halftone is described, each of which involves problems.

As disclosed in, for example, Patent Documents 1 and 2, there is a method called dynamic drive by which halftones are displayed by using amplitude, pulse width, or phase difference in the Selection stage in a driving wave that is divided into three stages: the Preparation stage, the Selection stage, and the Evolution stage. However, while this dynamic drive realizes quick operation, it causes large graininess in halftones. Also, generally, this dynamic drive requires a dedicated driver that can output voltages at several levels, and the cost increases because of the production of the driver and complexity of the control circuit.

Non Patent Document 1 discloses a dynamic drive that can be operated by an inexpensive and general purpose STN driver by improving the above dynamic drive. However, the problem of graininess is not solved by this dynamic drive.

Also, as a prior art method of driving halftones, there is a method disclosed in Patent Document 3 in which, by applying the second and third pulses immediately after applying the first pulse that makes liquid crystals into the homeotropic state, and a desired level of a halftone is displayed on the basis of the voltage difference between the second and third pulses. However, in this method, the probability of large graininess in halftones still remains, and also it is difficult to implement this method at a low cost because the driving voltage is high, which is problematic.

The above driving methods are methods in which the initial state does not matter and the halftone zone B is used; accordingly, even though it allows for quick operation, the graininess is large and the display quality is low, which is problematic.

Also, Non Patent Document 2 discloses another driving method that uses the halftone zone A. However, this method also has a problem.

In the method disclosed in Non Patent Document 2, short pulses are applied for using the cumulative response, which is peculiar to liquid crystals, and the liquid crystals are driven at a high speed of quasi moving-picture rate from the planar state to the focal conic state or from the focal conic state to the planar state.

However, in this method, the driving voltage can be as high as 50-70V because of the high quasi moving-picture rate, which causes a higher cost, and also causes a lower display quality because the "Two phase cumulative drive scheme" described in Non Patent document 2 uses the cumulative response in two directions, i.e., the cumulative response to the planar state and the cumulative response to the focal conic state (in other words, to the halftone zone A and the halftone zone B), by using the two stages "preparation phase" and "selection phase".

As described above, a display with a multilevel halftone in electronic paper that uses the conventional cholesteric liquid crystals requires a driver IC that is specially designed to create driving waveforms at multiple levels, and the driving voltage can be as high as 40-60V, thus requiring the IC to have a high voltage endurance, which has lead to a higher cost. Also, the conventional techniques have a problem with graininess being large in halftones (low uniformity), and it is difficult to apply them to electronic paper that requires a high display quality.

Also, in the conventional techniques, halftone levels are controlled by switching voltage values of voltage pulses or pulse widths for each pixel selected. This requires the construction of a driver IC or a peripheral circuit that can arbitrarily switch voltage values or the pulse widths, which has caused a higher cost. Also, as is disclosed in Patent Document 1, there is a method of driving halftones, the method using a driver that has a smaller number of outputs. However, while this method allows for high-speed display updates, it also requires a driving voltage of up to 50-60V. Also, in this method, the driving margin of halftones is narrow, and graininess in halftones is large even when an element having a high uniformity in its cell gaps is used (for example with glass components), which has caused difficulty in realizing a high-quality display.

Patent Document 1:
Japanese Patent Application Publication No. 2001-228459
Patent Document 2:
Japanese Patent Application Publication No. 2003-228045
Patent Document 3:
Japanese Patent Application Publication No. 2000-2869
Non Patent Document 1:
A Novel Dynamic Drive Scheme for Reflective Cholesteric Displays, SID 02 DIGEST, pp 546-549, 2002. (Nam-Seok-Lee, Hyun-SooShin, et al.)
Non Patent Document 2:
Cumulative Drive Schemes for Bistable Reflective Cholesteric LCDs, SID 98 DIGESTS, pp 798-801, 1998 (Y.-M. Zhu, D.-K. Yang)

SUMMARY OF THE INVENTION

It is an object of the present invention to provide a method of driving a liquid crystal display element, the method using an inexpensive and general purpose driver having a low voltage endurance, and the method being for realizing a multilevel halftone display that presents an excellent uniformity. In order to achieve this object, driving voltages and pulse widths are set to be variable for each step by applying, a plurality of times, pulses that are based on the cumulative response (overwriting) of liquid crystals, and the liquid crystals are controlled to be in a prescribed halftone state from the initial state of the reflection state by using a zone having a great margin. As a result of this, it is possible to prevent increases in the driving voltage, and accordingly a cheap general purpose driver that outputs binary values and that has a low voltage endurance can be used. Also, because a zone having a great margin is used for the halftone level conversion, a display with a multilevel halftone is realized while presenting an excellent uniformity even in an element with a low cell gap accuracy. Also, according to the present invention, it is possible to suppress increases in the number of overwriting times required even when the number of halftone levels increases.

DESCRIPTION OF THE PREFERRED EMBODIMENTS

Figure 2:
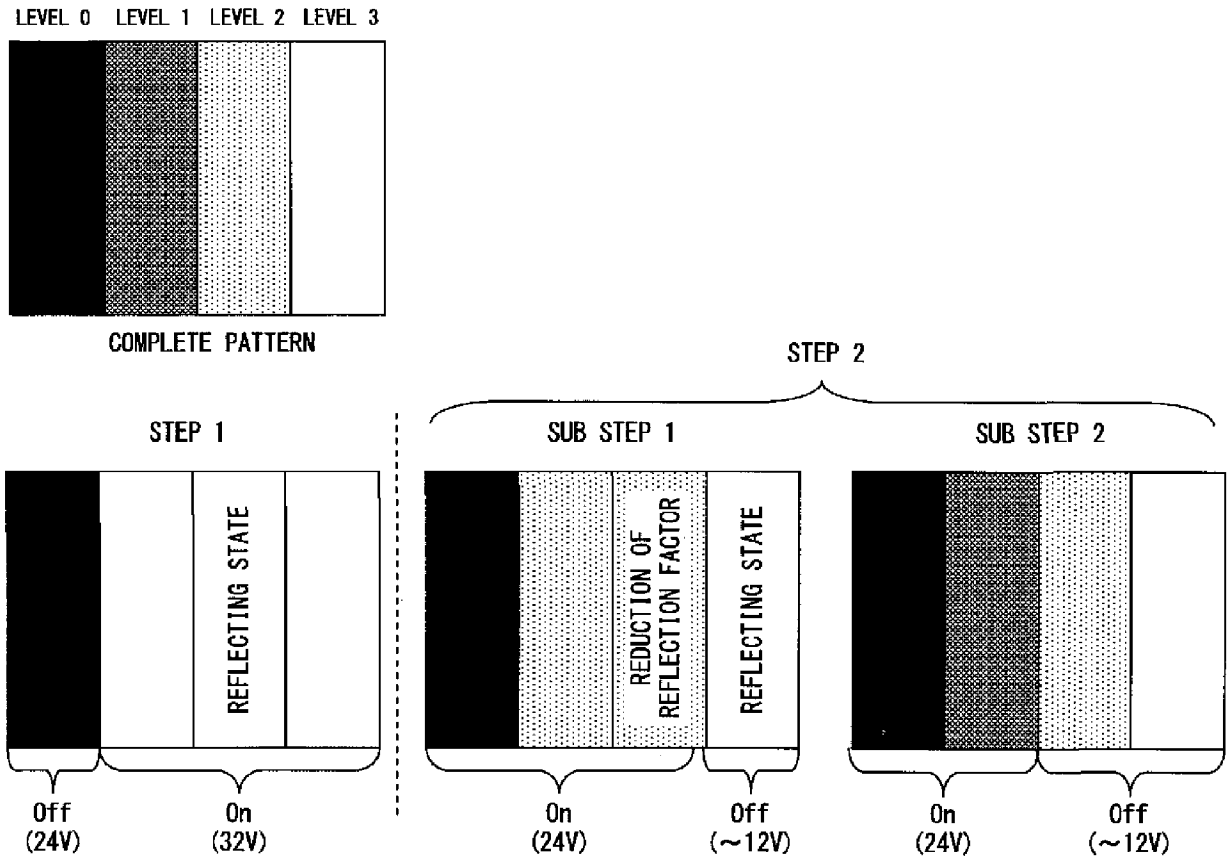
FIG. 2 shows a method of driving a display element according to a first embodiment.

First, by referring to FIG. 2, a first embodiment of the present invention is explained with an example of a display with four halftone levels. Because the example uses a four-level halftone display, each pixel in the displaying region is driven to display at one of the levels of a halftone ranging from level 0 through level 3 as shown as the complete pattern in FIG. 2.

As shown in FIG. 2, first in step 1, each pixel is driven to be in the planar state or in the focal conic state. Only the pixels at level 0 are driven to be in the focal conic state. In step 1, as shown in FIG. 2, driving to the planar state, i.e., to the reflection state is performed at 32V as the ON level, and driving to the focal conic state, i.e., to the non-reflection state is performed at 24V as the OFF level. Next, in substep 1 in step 2, regions other than the regions that have to be at level 3 of a halftone are selected, and the ON pulse (24V) that causes the transition to the focal conic state is applied to the selected regions. Then, the regions that have to be at level 1 and level 2 are driven to be at level 2. The region at the level 3 to which the OFF pulse (under 12V) remains in the planar state.

Figure 1A:
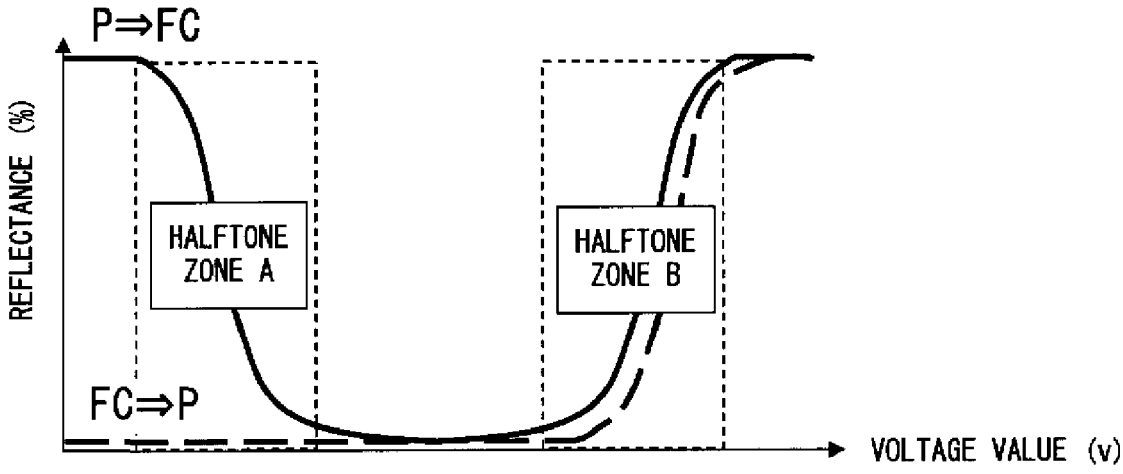
FIG. 1A shows a voltage response characteristic of cholesteric liquid crystals.

Next, in substep 2 in step 2, the ON pulse (24V) causing the transition to the focal conic state is applied to the regions that were selected in the above substep 1 and that are other than the region that has to be at level 2. As described above, in accordance with the level of halftone in the pixels, the transitions are sequentially caused from the planar state to the focal conic state in the halftone zone A in FIG. 1A.

Figure 1B:
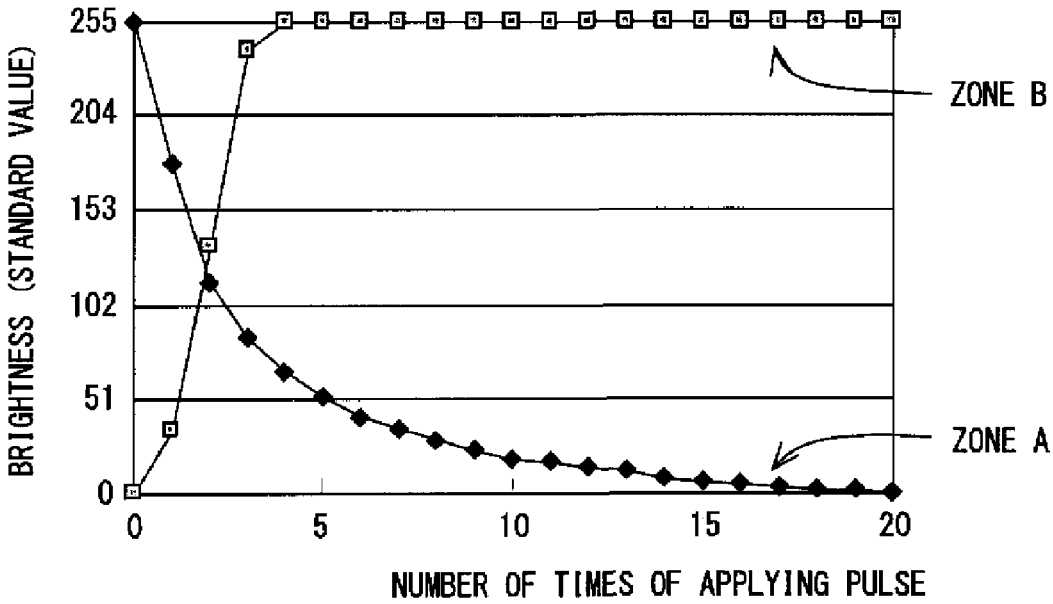
FIG. 1B shows a cumulative response characteristic of cholesteric liquid crystals.

As shown in FIG. 1B, the transition from the planar state to the focal conic state (zone A in FIG. 1B) is lower in the response characteristic than the transition from the focal conic state to the planar state (zone B in FIG. 1B) ($\gamma$ is moderate); accordingly, higher uniformity (smaller graininess) is realized and a greater number of halftone levels are realized by using the halftone zone A instead of using the halftone zone B.

Also, because a pulse is repeatedly applied to the pixels that have to be in a completely black state (level 0), a display at a high contrast with an excellent concentration of black is realized. If a pulse is applied only once in the focal conic state that is in black, weak scatter reflections remain, and the black tends to be faint.

Figure 1C:
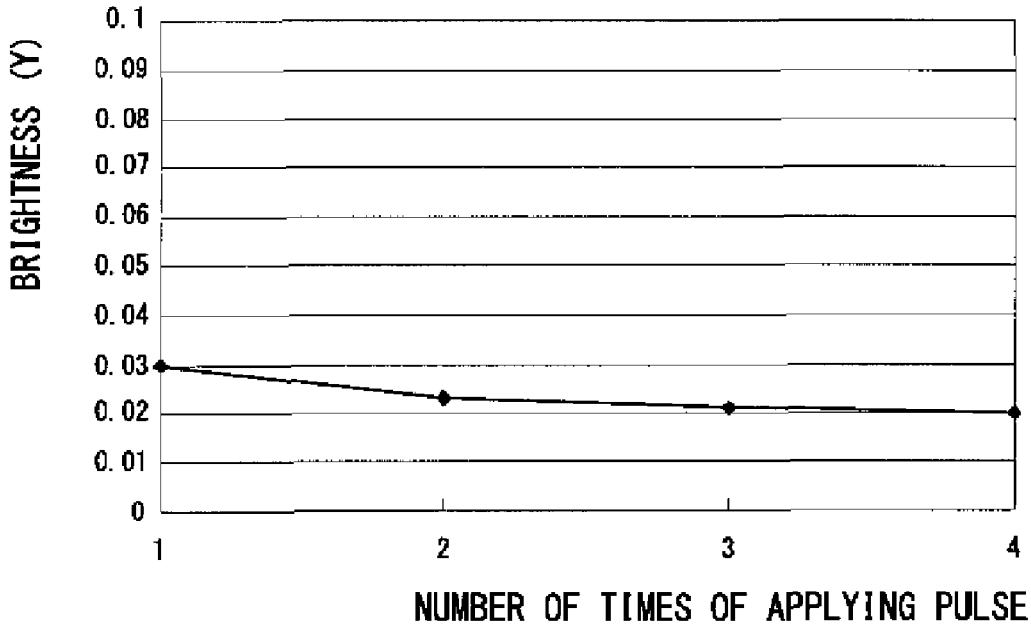
FIG. 1C shows a response characteristic in the focal conic state.
Figure 1D:
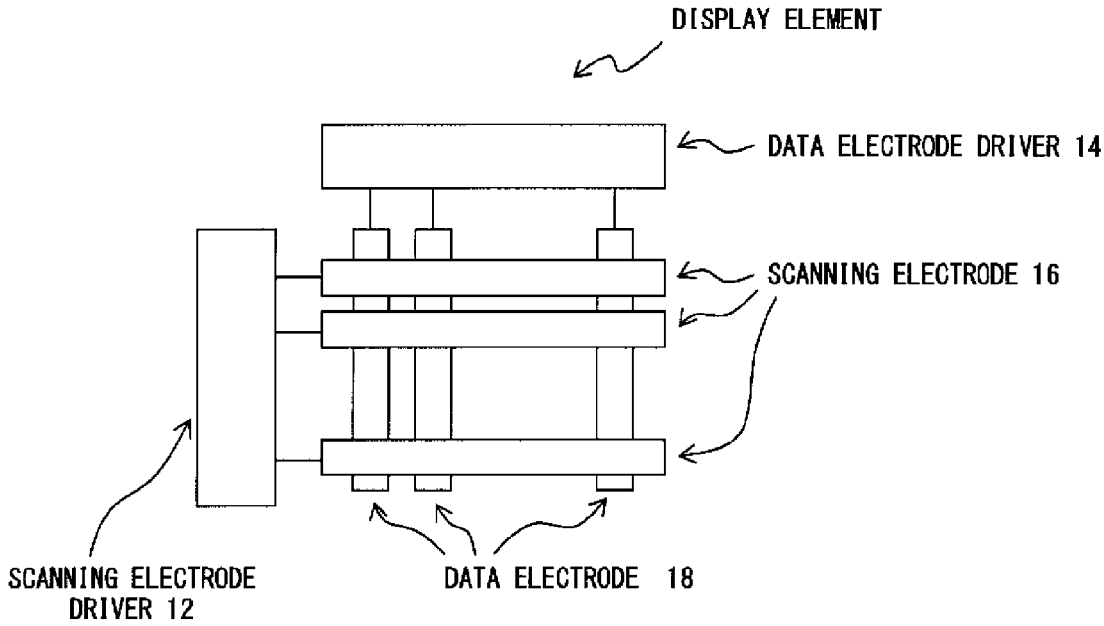
FIG. 1D shows an arrangement of driving electrodes used for a display element of the matrix type.

By contrast, in step 2 in the present invention, by repeatedly applying a pulse a plurality of times, the scatter reflections in the focal conic state can be gradually reduced, as shown in FIG. 1C, and a better black state can be realized. Also, a pulse at a low voltage can be used, and thereby it is possible to securely prevent the crosstalk in regions that are not selected.

Figure 3:
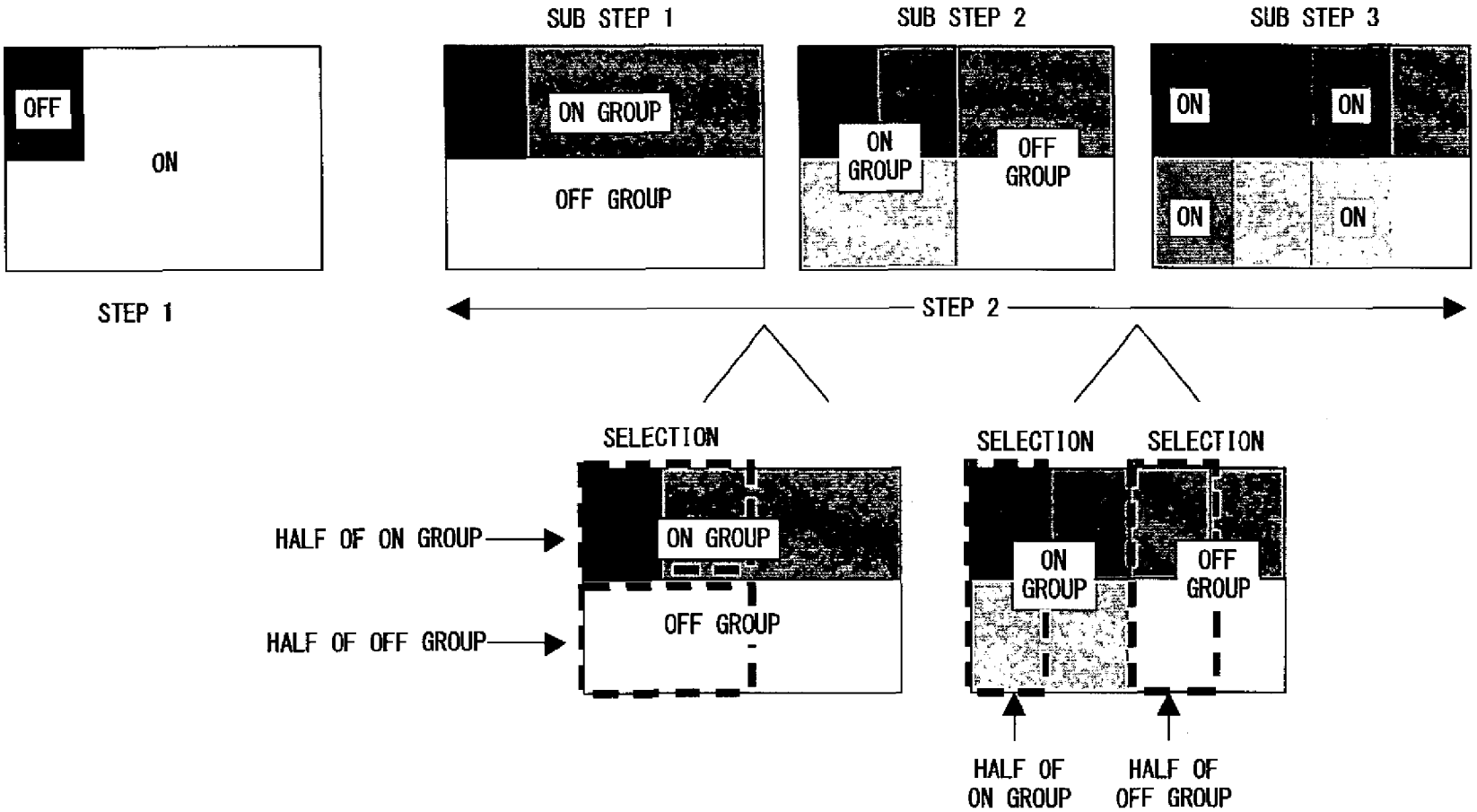
FIG. 3 shows a method of driving a display element according to a second embodiment.

Next, a second embodiment in which the number of driving times is reduced is explained by using a display example with eight halftone levels, which is shown in FIG. 3.

The operations performed until driving to the planar state and the focal conic state in step 1 are the same as those in the first embodiment. In step 2, in both the ON group that is to be driven and the OFF group that is not to be driven, the regions corresponding to halftone levels whose number is, for example, the half of the eight levels are selected, and the ON pulse is applied simultaneously to the selected regions as the ON group in substep 1 in step 2.

Next, a number of regions equal to half the number of the halftone levels are selected in both the ON group and the OFF group set in step 1, and the ON pulse is applied to the selected regions, which will be handled as the ON group in substep 2. This method is used in step 3; in other words, a number of regions equal to half the number of halftone levels are selected in each of the ON and OFF groups set in substep 2, and the ON pulse is applied to the selected regions, which will be handled as the ON group in substep 3.

Thereby, the respective regions are categorized into eight regions in accordance with whether or not the ON pulse is applied to each of the respective regions, ranging from the regions (in black) to which the ON pulse is applied in all the substeps 1 through 3 to the regions (in white) to which the ON pulse is not applied in any of the substeps 1 through 3. Thus, by applying different ON pulses respectively in the substeps, it is possible to form eight regions having different halftone levels, and the number of driving times in step 2 can be three.

In the driving method described in the first embodiment shown in FIG. 2, the driving has to be performed eight times in total, including seven times to be performed in step 2. However, according to the driving method in the second embodiment, it is possible to greatly reduce the number of driving times.

Additionally, even though an example of eight halftone levels is used in FIG. 3, it is obvious that the same manner can also be used when there are sixteen halftone levels or a greater number of halftone levels.

Next, an embodiment that can be applied to both the first and second embodiments is explained.

Figure 4A:
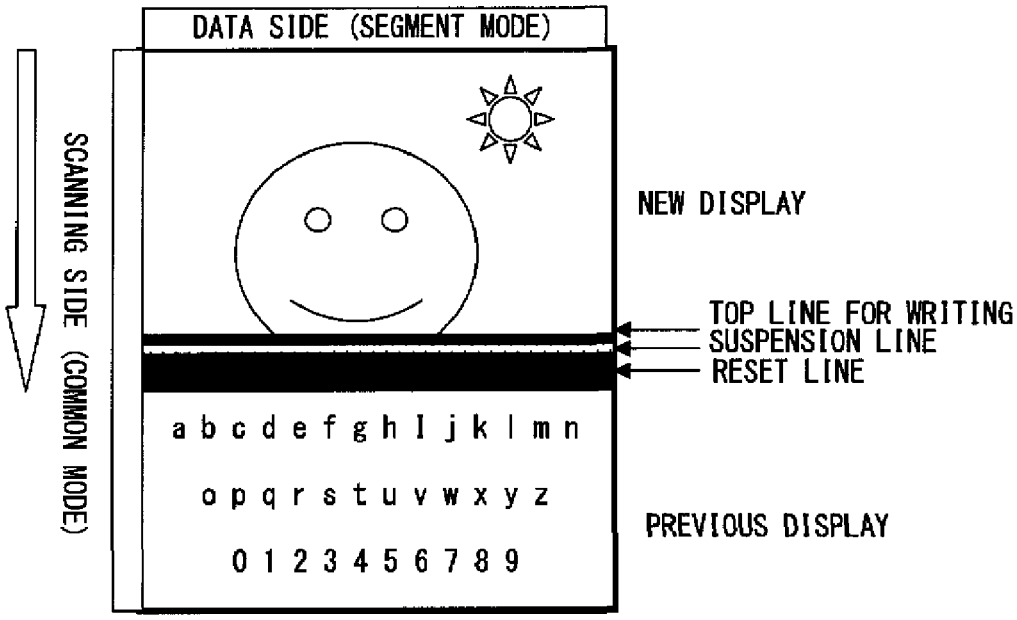
FIG. 4A shows a method of driving a display element when displayed information is to be rewritten.
Figure 4B:
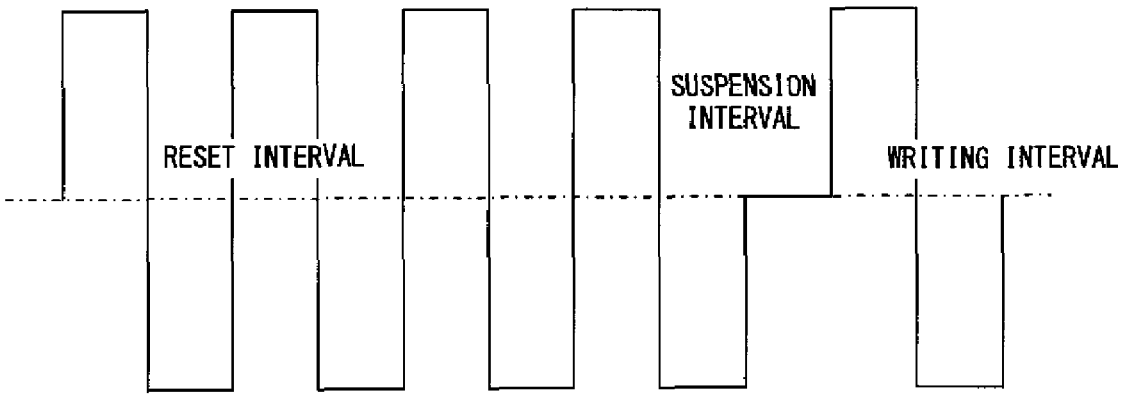
FIG. 4B shows a voltage applied to pixels on one line when displayed information is to be rewritten.
Figure 4C:
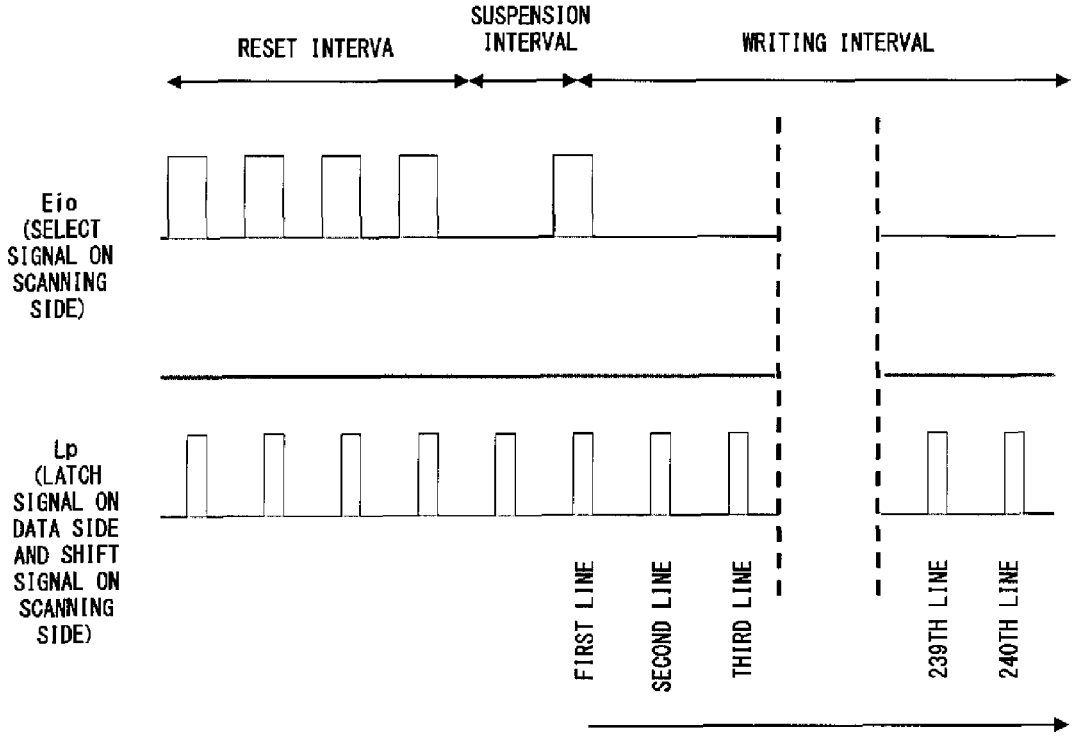
FIG. 4C shows operations of rewriting displayed information.

The embodiment shown in FIGS. 4A through 4C relates to a method of driving a display element when displayed information is to be rewritten.

Conventionally, for rewriting displayed information, a method in which all the displayed information is reset has been widely employed. However, at minimum several tens of mWs of electric power is consumed for resetting in this method.

In the present embodiment, in step 1 for driving a display element, the liquid crystals are reset to be in the homeotropic state or the focal conic state sequentially in units of a few lines. As shown in FIG. 4A, the liquid crystals are reset in units of, for example, four lines, and at the same time data writing for one line is performed. This operation is repeated the same number of times as the number of lines in order to rewrite the displayed information, which leads to a reduction in the electricity consumption.

FIG. 4B shows voltages applied to pixels on one line when the displayed information is to be rewritten.

One pulse consists of both positive and negative voltages, as will be explained in FIG. 5B. To the liquid crystal consisting of one pixel, the reset pulse is applied a plurality of times, e.g., four times as shown in FIG. 4B, and after a suspension interval, a writing voltage is applied in a writing interval.

By employing this reset driving method, it is possible to drive the reflection state and the non-reflection state in step 1 with a reduced amount of electricity consumed and at a high speed. Also, special reset data such as data for changing all the pixels to white is not used, and writing data itself is used for resetting.

In FIG. 4A, the lower portion shows the displayed information that has been previously displayed, and the upper portion shows new information to be displayed. The common mode described in FIG. 4A is a mode in which lines are sequentially selected, and the segment mode is a mode in which an applied voltage can be selected for each electrode. On the scanning side, lines are sequentially selected and the ON scan pulse is applied; on the data side, a pulse of the ON data or the off data is applied in accordance with the data that is to be displayed. FIG. 4A shows a state in which the top line for writing, i.e., above mentioned line written one by one has wrapped around to the middle of the screen after starting from the first line, and together with the performance of writing on the top line, resetting is performed by using writing data on, for example, four resetting lines. This operation is explained further by referring to FIG. 4C.

As shown in FIG. 4C, first, four lines are set to be reset lines. In FIG. 4C, when an Eio signal, which is a signal for starting scanning on the scanning side, and an Lp signal, which gives the timing for latching on the data side and the timing for shifting on the scanning side, are simultaneously input, the first line counting from the top of the screen in FIG. 4A is selected, and the line enters into a state in which data can be written. Next, when the second pulse of the Eio and Lp signals are input together, the line selected first is shifted by the Lp signal, and the second line is selected. Also, the first line is simultaneously selected by the Eio signal that was input together with the Lp signal, and thereby two lines, i.e., the first and second lines, are selected. By repeating this operation in the reset interval, the first through fourth lines are selected and a state is caused in which data can be written on these four lines.

In the next suspension interval, only the Lp signal is input, and by using this pulse, shifting is performed by one line, and the second through fifth lines are selected on the screen.

The Eio and Lp signals are simultaneously input in the next writing interval, and the second and fifth lines that have been selected are shifted by one line each. As a result of this, the third through sixth lines are selected, and the first line on the screen is selected on the basis of the input of the Eio signal. By giving data of the first line in this state, the data that is to be written is written on the first line, and the data on the first line is given to the third through sixth lines as the data for resetting, and data that was previously displayed is reset. During this operation, the second line is the suspension line that is set in the suspension interval, and data is not written.

In response to the next input of the Lp pulse, the previously selected line is shifted, and the second line and the fourth through seventh lines are selected. In this state, the data on the second line is given, and data that is to be written is written on the second line, and the previously displayed data on the fourth through seventh lines are reset.

Further, on the basis of the next input of the Lp pulse, the third line and the fifth through eighth lines are selected in the same manner, and data is written on the third line. On the third line, the data on the first line was written when the secondary previous LP pulse was input. However, generally, the response time of cholesteric liquid crystals is on the order of several tens of milliseconds, although this value varies in accordance with the materials. At the moment when the Lp pulse is input and the data on the second line is written, the third line is in the suspension interval, and in this interval (equal to or less than 50 ms for example), the pixels on the third line are in a transitive state to the focal conic state or to the planar state, and when the data on the third line is actually given, one of the above two states is selected as the state in which data is written. These operations are repeated until data is written on the two hundred and fortieth line, i.e., the bottom line on the screen.

Figure 5A:
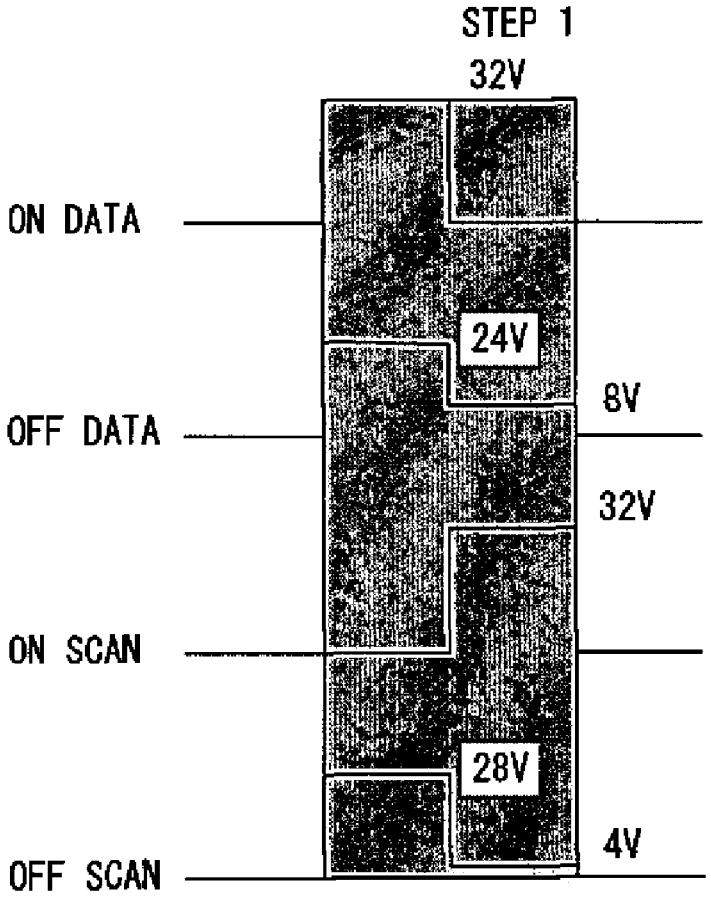
FIG. 5A shows voltages applied to driving electrodes in step 1.
Figure 5B:
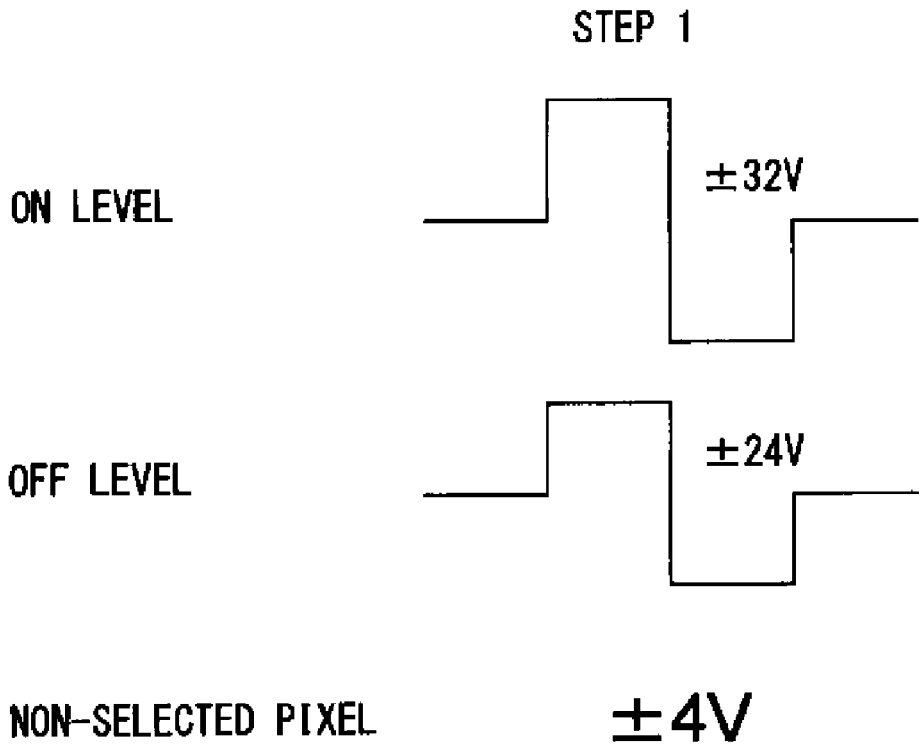
FIG. 5B shows voltages applied to respective pixels in step 1.

Next, by referring to FIGS. 5A and 5B, driving of the display element in step 1 is explained. The voltage for the ON scan and the voltage for the OFF scan shown in FIG. 5A are respectively applied to the selected scanning electrode and to other scanning electrodes, and the voltage of the ON data described in FIG. 5A is applied to the data electrode corresponding to the pixel to which the ON pulse has to be applied on the line, and the voltage of the OFF data is applied to other electrodes.

In the example of FIG. 5A, a voltage at 32V in the first half and 0V in the last half is applied to the ON data, and a voltage at 24V in the first half and 8V in the last half is applied to the OFF data. A voltage at 0V in the first half and 32V in the last half is applied to the ON scan, and a voltage at 28V in the first half and 4V in the last half is applied to the OFF scan.

The difference between the voltage applied to the ON data or OFF data and the voltage applied to the ON scan or OFF scan is applied to each pixel, and accordingly a voltage waveform of the ON level (32V in the first half and −32V in the last half) or the OFF level (24V in the first half and −24V in the last half), which are respectively shown in FIG. 5B, is applied to the pixels on the selected scanning line, and the voltage at 4V in the first half and −4V in the last half is applied to the non-selected pixels. Usually, general purpose drivers output binary values of the ON waveform and the OFF waveform. In step 1 in the present invention, as shown in FIG. 5A, liquid crystals are driven to the planar state by setting the ON waveform to be, for example, at 32V, and are driven to the focal conic state by setting the OFF waveform to be, for example, at 24V. Also, using alternating pulses for driving liquid crystals as described above is a commonly used technique for preventing the degradation of liquid crystals.

Figure 6:
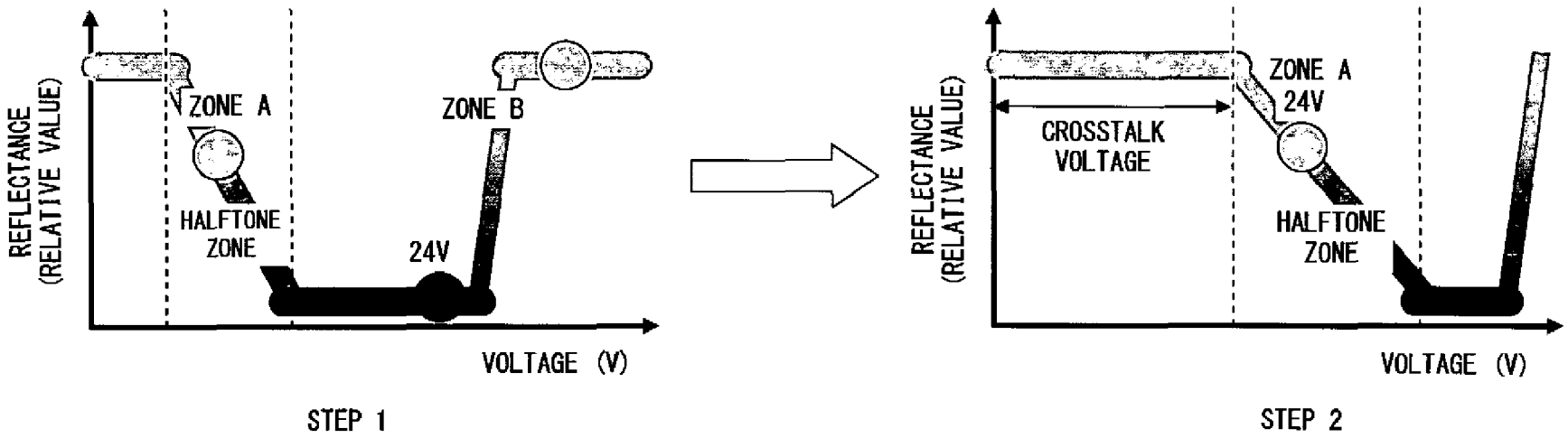
FIG. 6 shows a manner of driving a display element in step 2 in comparison with that in step 1.

Next, driving of the display element in step 2 is explained by referring to FIG. 6.

In step 2 in the present invention, scanning is performed at a higher speed than in step 1, or the pulse width is reduced. When the scanning speed in step 1 is set to be two milliseconds per line, the response characteristic as shown in FIG. 6 is obtained, and the state is a focal conic state with a voltage at 24V. In contrast, when the scanning speed is one millisecond per line as in step 2, the response characteristic is shifted as shown in FIG. 6, and the state is in the halftone zone A with a voltage at 24V. However, the response characteristics with respect to speeds (milliseconds per line) vary in accordance with liquid crystal materials and structures of display elements; thus, the scope of the present invention is not limited to this example.

The reflectance in the region that was made to be a reflecting state in step 1 is reduced (mixed with the focal conic state) by using the ON waveform at 24V in step 2. While performing this process, the OFF waveform is set to be, for example, about 12V in order to maintain the reflecting state even when the OFF waveform is applied to liquid crystals in the reflecting state.

Figure 7A:
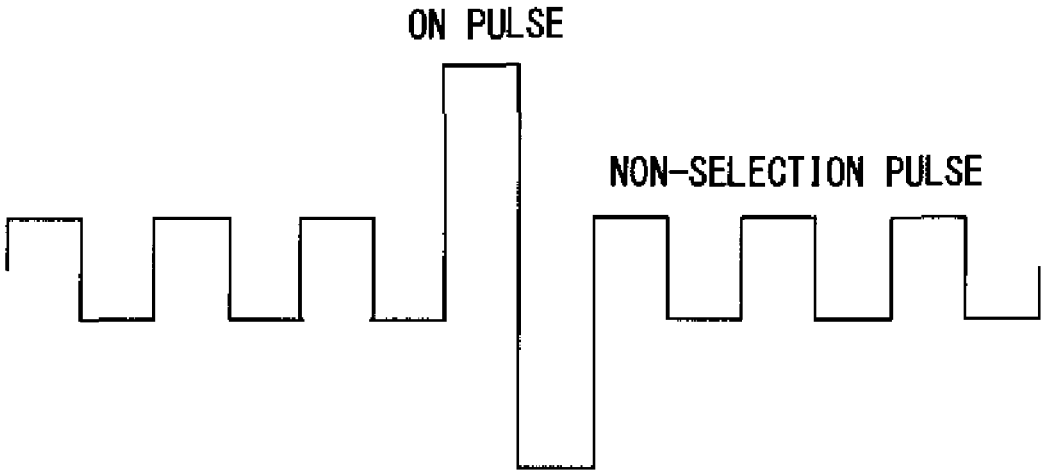
FIG. 7A shows a waveform of a normal ON pulse that drives a display element.
Figure 7B:
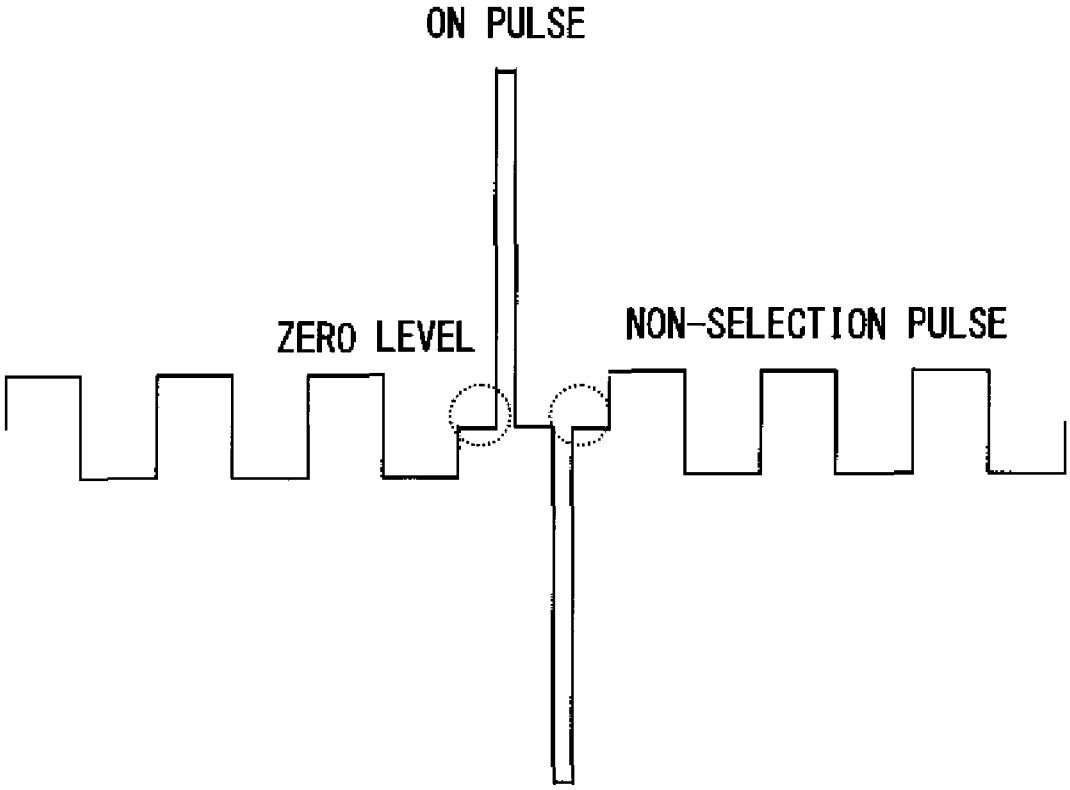
FIG. 7B shows a waveform of an ON pulse in an embodiment of the present invention.

Next, by referring to FIGS. 7A and 7B, a method of driving the display element when the pulse of the ON signal is applied is explained. The ON pulse shown in FIG. 7A has a normal and conventional waveform. In contrast, in the driving method in the present embodiment, the levels before and after the ON pulse are forcibly made to be zero, as shown in FIG. 7B.

The inventors ascertained that the two merits as below are achieved by the above operation.

(1) Better γ characteristic: The γ characteristic is moderate with a higher voltage and with a waveform having a pulse width, as shown in FIG. 7B, that is smaller than a normal waveform, as shown in FIG. 7A.

Therefore it can display greater number of halftone levels.

(2) Better suppression of crosstalk: With a normal waveform, as shown in FIG. 7A, the non-selection pulse is applied immediately after the ON pulse. In other words, the non-selection pulse is applied before the state of the liquid crystals becomes stable, which causes crosstalk especially to halftones. In contrast, by making the levels before and after the ON pulse zero as shown in FIG. 7B, it is possible to cause the state of the liquid crystals that changed due to the ON pulse to become stable before the non-selection pulse is applied; accordingly, it is possible to suppress the influence of the crosstalk.

Therefore, it is desirable to employ the above driving method in the respective substeps in step 2.

Figure 8:
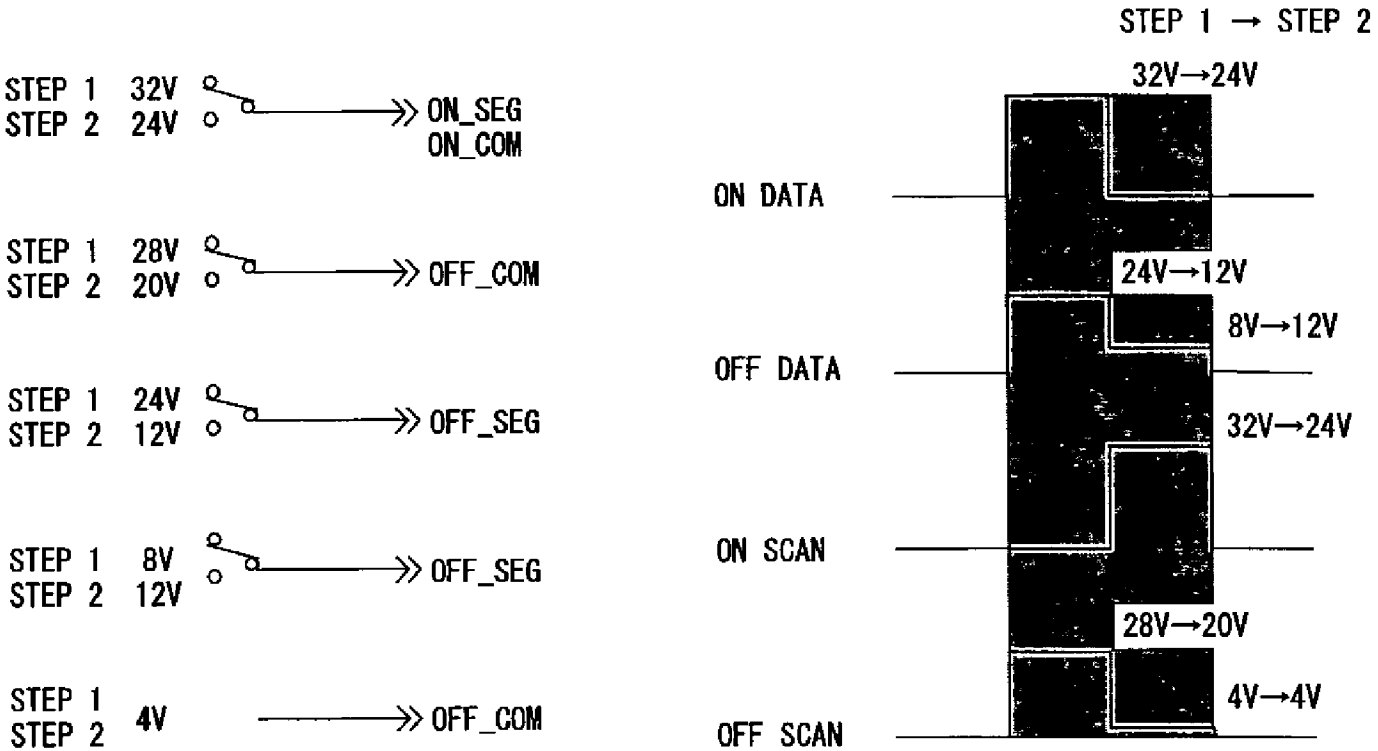
FIG. 8 shows an example of voltage switching between step 1 and step 2.

Next, by referring to FIG. 8, an example of voltage switching between steps 1 and 2 is explained. As described above, different voltage values of the ON/OFF pulses are used between steps 1 and 2. For this voltage switching, it is convenient to use an analog switch.

In FIG. 8, an output that is switched to 32V in step 1 and is switched to 24V in step 2 is supplied as the ON pulse for the segment mode and the common mode, and the waveforms are shown. Similarly, the waveform of the OFF pulse for the common mode is shown as the waveform for the OFF scan, and the waveform of the OFF pulse for the segment mode is shown as the waveform for the OFF data.

Figure 9:
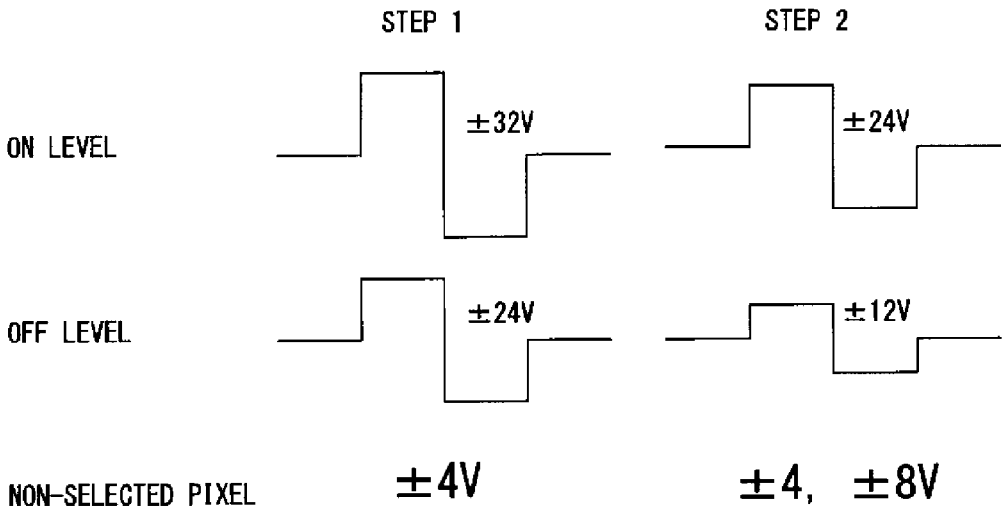
FIG. 9 shows voltages applied to the respective pixels in step 1 and step 2.

By switching in this manner, the waveforms respectively of ON and OFF as shown in FIG. 9 are applied to each pixel. The difference in the voltages between the waveform of the ON data and the waveform of the ON scan is applied to, for example, the pixels to which the pulse at the ON level is applied. Accordingly, ±32V is applied in step 1, and ±24V is applied in step 2.

Figure 10:
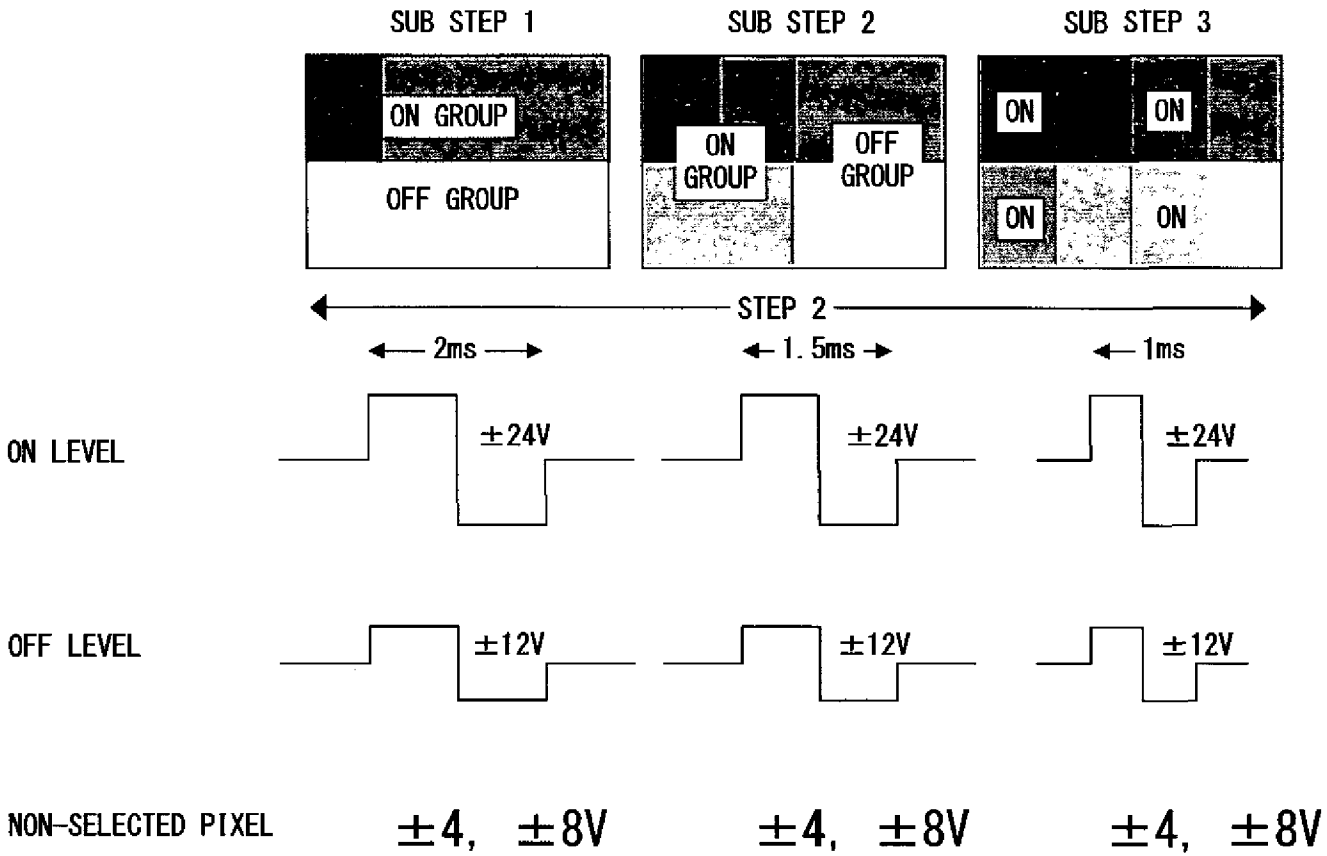
FIG. 10 shows different ways of driving a display element in the respective substeps in step 2.

Next, driving the display element in the respective substeps in step 2 is explained by referring to FIG. 10. As previously described in the second embodiment in FIG. 3, it is necessary to apply ON pulses that are different over the respective substeps. Accordingly, in the respective substeps in step 2, the pulse widths are set to be appropriate values as shown in FIG. 10. The higher the concentration of black is, the lower the scan speed is set to be or the wider the pulse width is set to be. By lowering the clock frequency at which the driver is driven and making the output cycle of the driver longer, the width of the ON pulse as the output of the driver can be widened. This switching of the pulse width can be performed more stably by changing logically the ratio of frequency division in the clock generation unit that inputs the clock into the driver than by switching the clock frequency itself in an analog manner.

Figure 11:
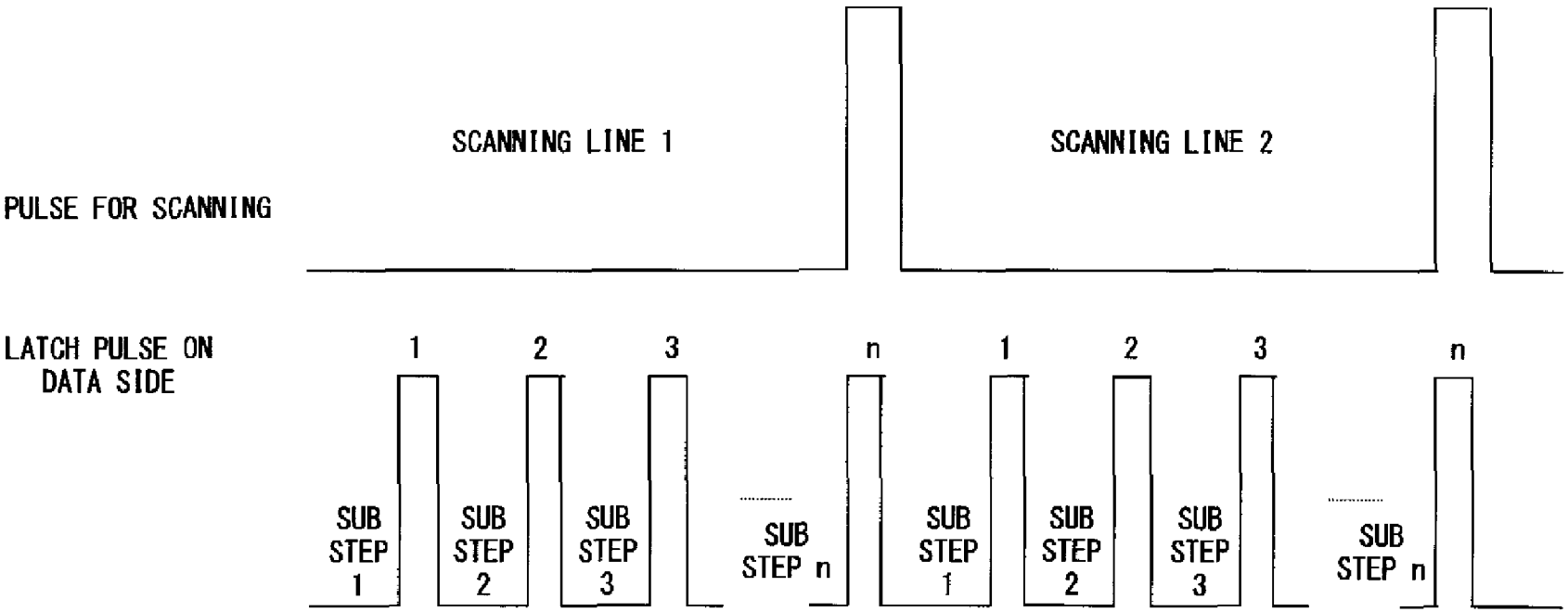
FIG. 11 shows the execution of a plurality of substeps during the scanning of one line.

Next, by referring to FIG. 11, a driving method is explained by which the number of scanning iterations can be reduced even when the ON pulse is applied to one and the same pixel a plurality of times.

FIG. 11 shows a relationship between the pulse for scanning and the latch pulse on the data side, and also shows that a plurality of substeps are executed in one scanning line. It is possible to execute one substep on one scanning line. However, in this configuration, scanning is performed five times in total in steps 1 and 2 in the case when there are, for example, eight halftone levels. However, when the number of scanning times is reduced, the flicker during writing process is reduced, which is favorable for users. Accordingly, in order to reduce the number of scanning iterations, the latch pulses of a plurality of substeps for one scanning iteration are applied. Thereby, the number of scanning iterations is reduced, and a writing process with reduced flicker is realized.

In the above, it is desirable to make steps 1 and 2 independent of each other. In other words, it is desirable for writing to be performed for one whole image only by step 1, and then for writing to be performed for the one whole image by step 2. Thereby, it is possible for a user to conceive the whole of the image at an earlier time.

Figure 12:
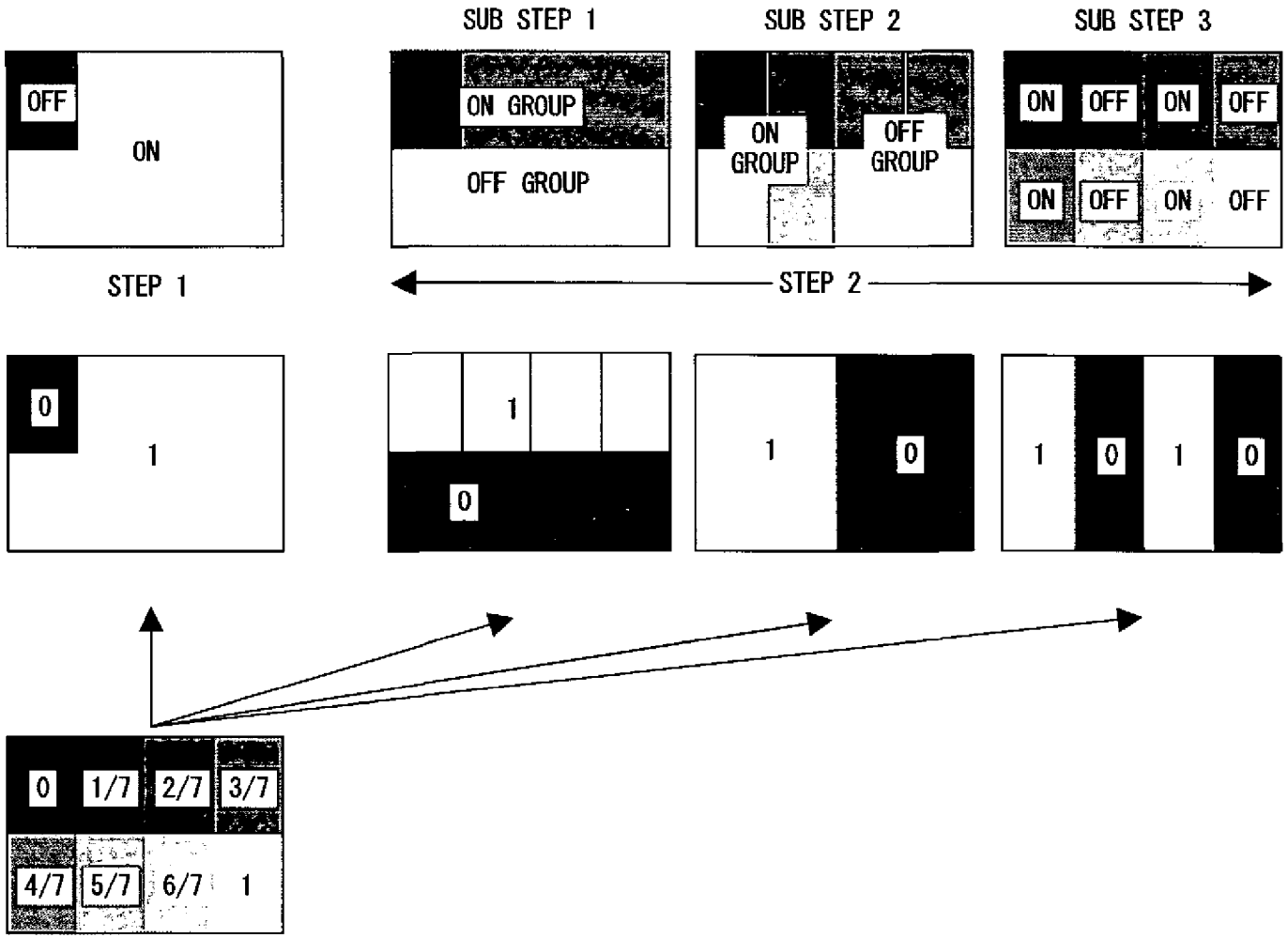
FIG. 12 shows a process of generating sub image data for driving a display element from image data with a multilevel halftone.

FIG. 12 shows a process of generating sub-image data for driving the display element from image data with a multilevel halftone. By referring to FIG. 12, a process is explained for image data that gradation has been converted into data with eight halftone levels by using the error diffusion method or another such method. As described above, in the second embodiment, a display with eight halftone levels is realized by applying a pulse four times in steps 1 and 2. However, as for an image data processing, as shown in FIG. 12, the image with eight halftone levels is divided into four sub-images such that the number of sub-images corresponds to the number of iterations of applying the pulse.

In the above configuration, the portions on which the reflectance is to be lowered by the ON pulse become white (1) in the concept of the sub-image data, and the portions on which the reflectance is to be maintained by applying the OFF pulse become black (0) in the concept of the sub-image data. In other words, binary data having 0 or 1 for expressing the application of the ON pulse or the OFF pulse is generated as sub-image data for each sub-image. Additionally, in consideration of image quality, the algorithm used for the halftone transformation should desirably be either the error diffusion method or the blue noise mask method.

Figure 13:
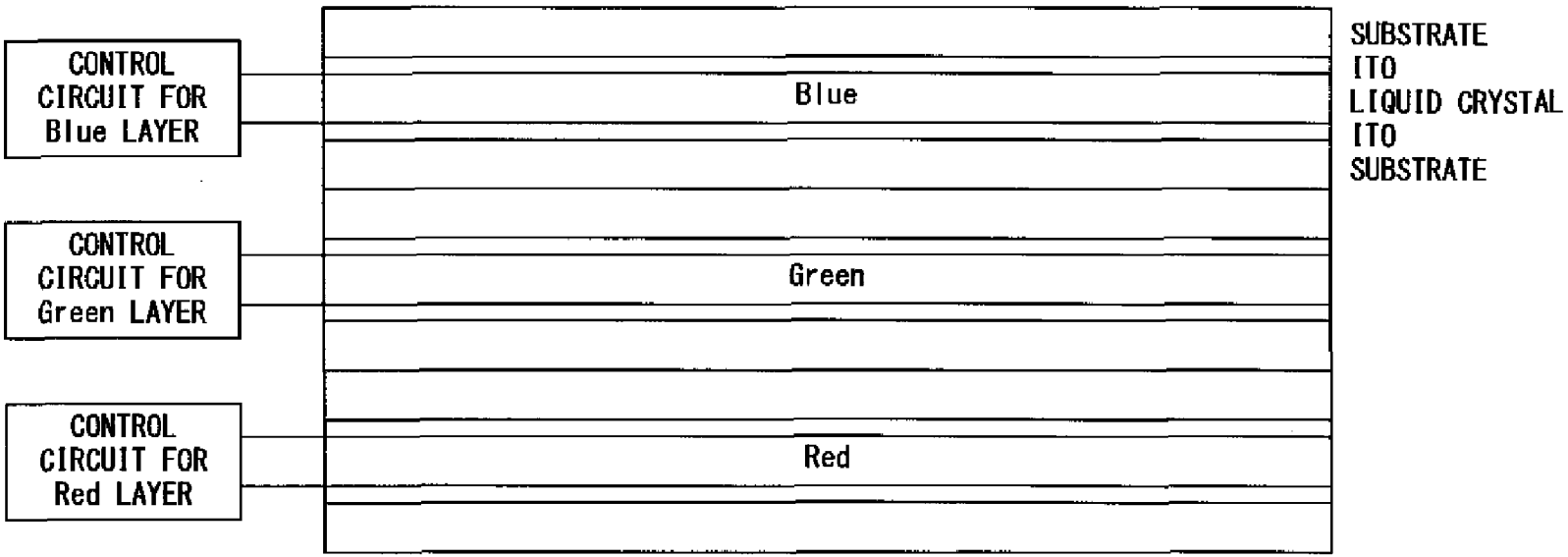
FIG. 13 shows a layered structure of a display element for realizing a display in full color.
Figure 14:
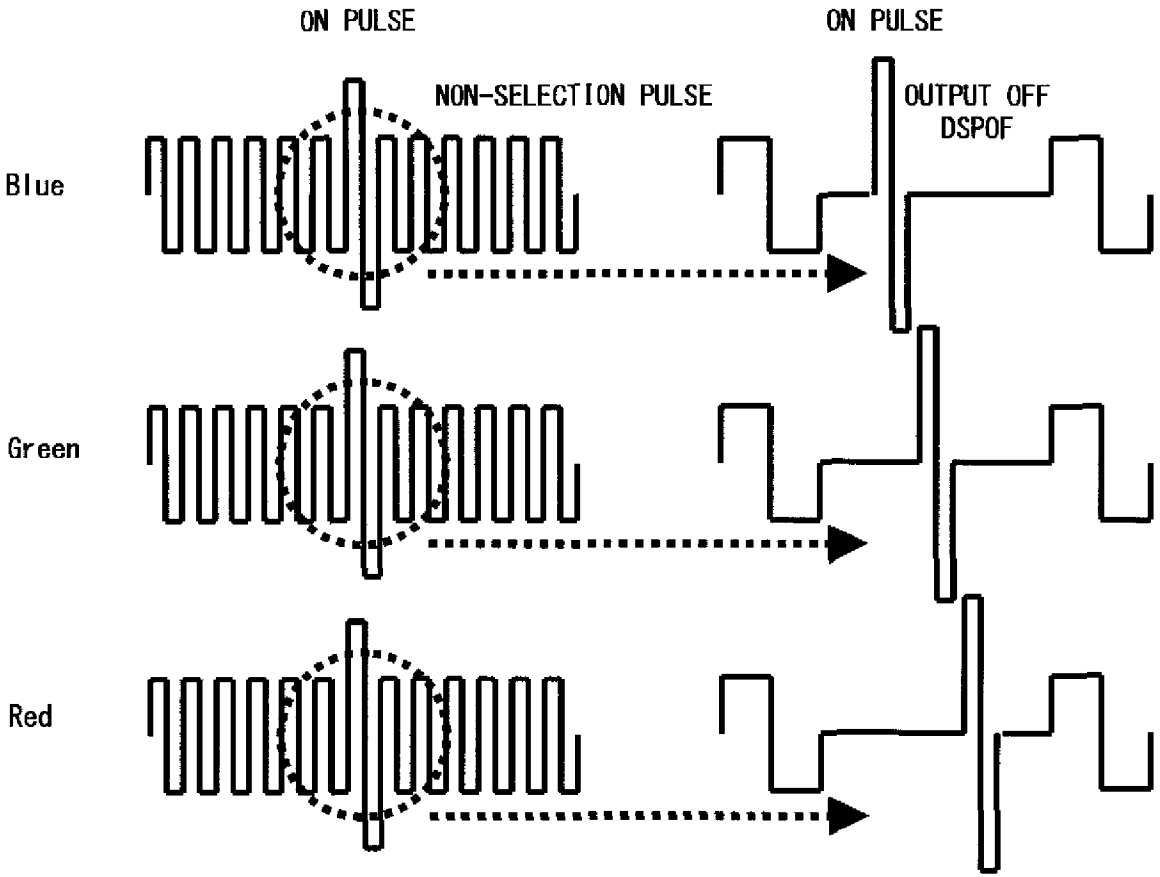
FIG. 14 shows a method of driving ON pulses for a display in full color.

Next, a driving method for a full color display is explained by referring to FIGS. 13 and 14.

FIG. 13 shows a layered structure in a display element for a full color display. As shown in FIG. 13, a layered structure consisting of, for example, RGB elements are commonly used to realize a display in full color by using cholesteric liquid crystals. Further, control circuits respectively corresponding to the layers are used. The display elements of the respective layers are driven by voltage waveforms that are independent of one another, and as a result a display in full color is realized.

FIG. 14 shows a method of driving the ON pulse for realizing a display in full color.

As shown in FIG. 7B, in the embodiments of the present invention, the levels before and after the ON pulse are forcibly made to be zero, and a waveform at a higher voltage and with a smaller pulse width for the ON pulse is employed. However, the positions of the ON pulses of the respective RGB elements are offset in order to avoid the same timing. This is because when the respective RGB elements are driven at one and the same timing in the configuration of the layered structure for display elements, the spike current increases, and the power voltage becomes unstable so that the display quality deteriorates and malfunctions may be caused.

In order to lower this spike current, the application timings for the DSPOF signals that are indicative of the timings of forcibly making the applied voltages zero are offset such that the positions of the ON pulses do not overlap each other when driving the respective RGB elements.

It is recognized that, by employing the above configuration, the driving circuit operates stably and an excellent quality of displaying is realized.

As described above, by employing the driving method according to the present invention, an inexpensive and general purpose driver/component having a voltage endurance equal to or lower than 40V can be used for the driving.

Figure 15:
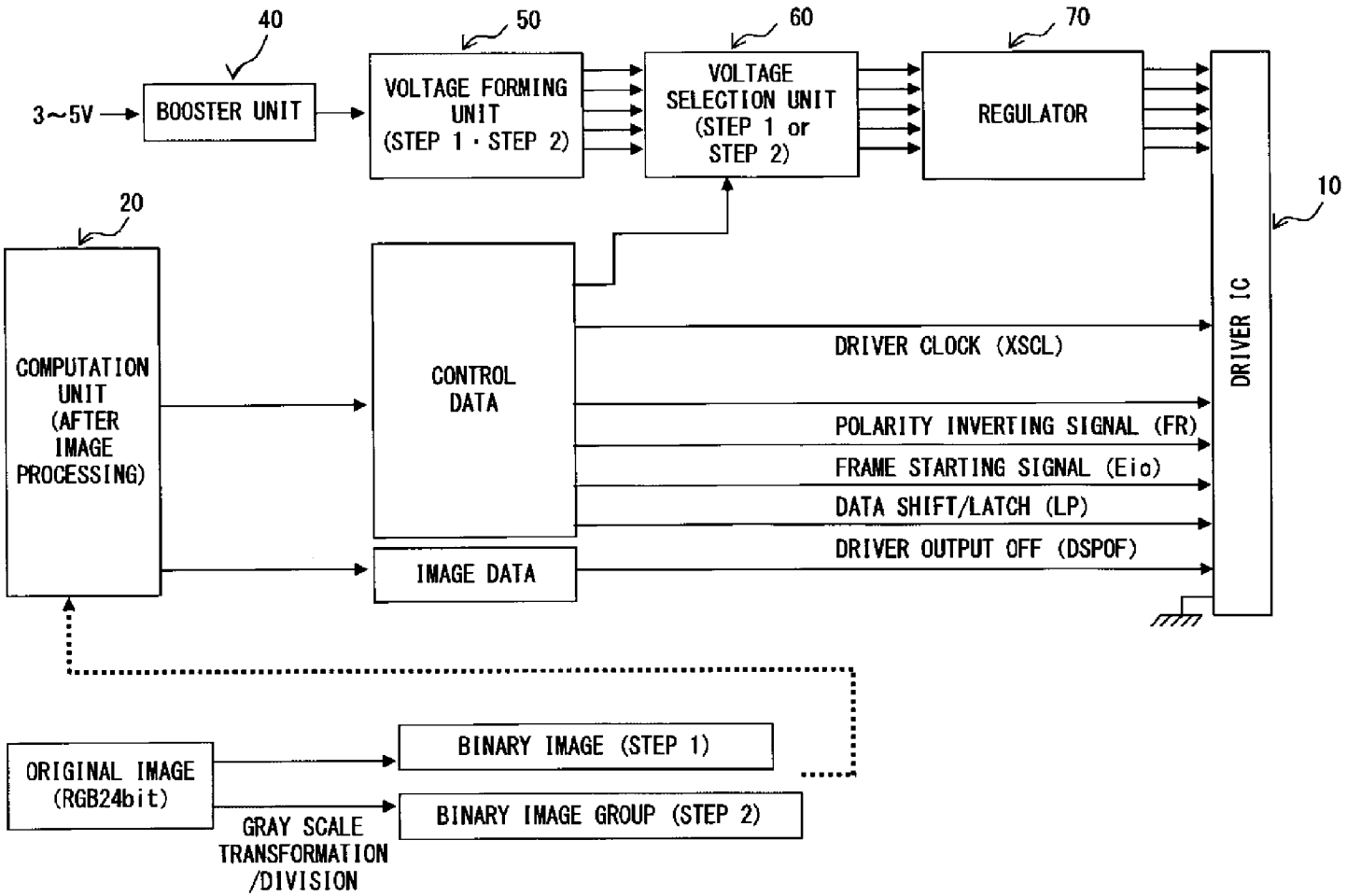
FIG. 15 shows an example of a block configuration of a driving circuit according to the present invention.

Next, an example of a configuration of blocks of driving circuits that implement the method of driving the display element according to the present invention is explained by referring to FIG. 15. A driver IC 10 includes a scan driver and a data driver. A computation unit 20 outputs to the driver IC 10 binary image data obtained from the original image for step 1 and image data that consists of a group of binary images for step 2 obtained by a halftone transformation from an original image and by the division process explained in FIG. 12, and outputs to the driver IC 10 various control data.

A data shift/latch signal is a signal for controlling a shift from one scanning line to the next scanning line and for controlling the latch of data signal. A polarity inverting signal is a signal for inverting outputs from the driver IC 10 that is unipolar. A frame starting signal is a synchronization signal for starting a writing process for one screen. A driver clock is a signal indicative of a timing for reading image data. A driver-output-off signal is a signal for forcibly making the driver outputs zero.

The driving voltage input to the driver IC is boosted from a logical voltage 3V to 5V by a booster unit 40. Various voltages are formed by a voltage forming unit 50. A voltage selection unit 60 selects a voltage that is to be input to the driver IC 10 from among the voltages formed by the booster unit 40, in accordance with the control data output from the computation unit 20, and the selected voltage is input into the driver IC 10 via a regulator 70.

Next, a preferred embodiment for a reflection liquid crystal display element according to the present invention is explained by referring to the attached drawings, and a specific liquid crystal composition example of the embodiment is explained.

Figure 16:
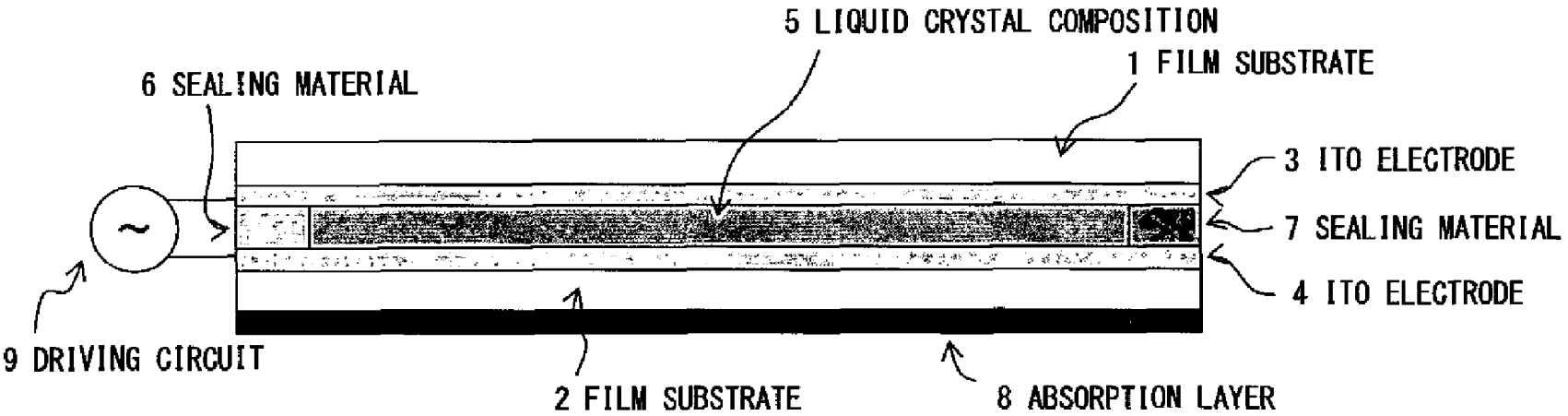
FIG. 16 is a cross-sectional view of an example of a display element.

FIG. 16 shows the cross section of the structure of the preferred embodiment of the liquid crystal display element to which the driving method according to the present invention is applied. This liquid crystal display element has an ability to hold a display state semi-permanently, and the planar state and focal conic state are maintained even after application of a pulse voltage is stopped. The liquid crystal display element includes a liquid crystal composition 5 between electrodes. Electrodes 3 and 4 face each other in such a manner that they cross each other when viewed from the direction orthogonal to the substrate. The electrodes are desirably coated with an insulative thin film or an orientation stability film. Also, a visible light absorption layer 8 is provided on the surface (bottom surface) of the substrate opposite to the side to which light is incident.

In the liquid crystal display element according to the present invention, the numeral 5 denotes a cholesteric liquid crystal composition that presents a cholesteric phase at room temperature. Materials and combinations of the materials for this composition are specifically explained below on the basis of experiments.

The numerals 6 and 7 denote sealing materials. The sealing materials 6 and 7 are for sealing the liquid crystal composition 5 between substrates 1 and 2. The numeral 9 denotes a driving circuit for applying a prescribed pulse voltage to the electrodes.

The substrates 1 and 2 are both transparent, but in the present invention, at least one of the substrates that constitute a pair has to be transparent. As a transparent substrate used in the present invention, a glass substrate can be used, but a film substrate such as PET, PC or the like can also be used.

For the electrodes 3 and 4, Indium Tin Oxide (ITO) can be used as a representative example. However, a transparent conductive film such as a film of Indium Zinc Oxide (IZO) or the like, a metal electrode such as an electrode of aluminum, silicon or the like, and a photoconductive film such as a film of amorphous silicon, BSO (Bismuth Silicon Oxide) or the like can be used. In the liquid crystal display element shown in FIG. 16, a plurality of belt shaped transparent electrodes 3 and 4 that are parallel to each other are formed on the surfaces of the transparent substrates 1 and 2, and these electrodes face each other in such a manner that they cross each other when viewed from the direction orthogonal to the substrate.

Next, preferred factors that can be applied to the liquid crystal display element according to the present invention are explained, although this is not shown in FIG. 16.

(Insulative Thin Film)

The liquid crystal display elements according to the present invention (including the liquid crystal display element shown in FIG. 16) may include an insulative thin film that functions to prevent short circuits between electrodes and serves as a gas-barrier layer so as to improve the reliability of liquid crystal display elements.

(Orientation Stability Film)

Examples for the orientation stability film are organic films such as films of polyimide resin, polyamide-imide resin, polyetherimide resin, Poly(vinyl butyral) resin, akryl resin or the like and inorganic materials such as oxide silicon, oxidized aluminum or the like. In the present embodiment, the electrodes 3 and 4 are coated with orientation stability films Also, orientation stability films can be used as insulative thin films.

(Spacer)

The liquid crystal display elements according to the present invention (including the liquid crystal display element shown in FIG. 16) may include spacers between a pair of substrates in order to keep the gap between the substrates constant.

In the liquid crystal display element according to the present embodiment, spacers are provided between the substrates 1 and 2. An example of a spacer that can be used here is a ball made of resin or inorganic oxide. Alternately, a fixation spacer with thermoplastic resin coated thereon can be used.

Next, the liquid crystal composition is explained. The liquid crystal composition that constitutes the liquid crystal layers is a cholesteric liquid crystal that is obtained by adding 10 wt % through 40 wt % of a chiral agent to a nematic liquid crystal mixture. The amount of the added chiral agent is the amount that the total amount of the nematic liquid crystal component and the chiral agent is 100 w %.

Various types of conventional nematic liquid crystals can be used. However, it is desirable to use liquid crystals having a dielectric anisotropy of 20 or higher in view of driving voltage. If the dielectric anisotropy is 20 or higher, the driving voltage can be reduced to a relatively lower value. It is desirable for the dielectric anisotropy ($\Delta\in$) of the cholesteric liquid crystal composition to be between 20 and 50.

Also, it is desirable for the refraction index anisotropy ($\Delta n$) to be between 0.18 and 0.24. If the refraction index anisotropy is lower than this range, the reflectance in the planar state decreases, and if the refraction index anisotropy is higher than this range, the scatter reflections in the focal conic state increase, and the viscosity also increases, which decreases the response speed.

It is desirable that the thickness of this liquid crystal be in the range from 3 μm through 6 μm. If the thickness is less than this range, the reflectance in the planar state decreases, and if the thickness is greater than this range, the driving voltage becomes too high.

Next, example experiment 1 according to the present invention is explained in which a display element with eight halftone levels in monochrome and with a Q-VGA resolution was produced and used.

Liquid crystals display green in the planar state, and display black in the focal conic state.

As driver ICs, two devices having the product number S1D17A03 (with 160 outputs) and one device having the product number S1D17A04 (with 240 outputs) were used, all of which are general purpose STN drivers manufactured by EPSON CO. The driving circuit was set in such a manner that the 320 outputs were the data side and the 240 outputs were the scanning side. In the above setting process, the voltage input to the driver may be stabilized by using a voltage follower of an operational amplifier if necessary. Additionally, it is obvious that any device can be used as the driver IC as long as the device has the same function as that of the driver IC.

The voltages input into the driver ICs were 32V, 28V, 24V, 8V, 4V, and 0V in step 1 (shown in FIG. 8), and were 24V, 20V, 12V, 12V, 4V, and 0V in step 2. An analog switch provided in a stage earlier than the operational amplifier was used for switching the voltages in steps 1 and 2. For this analog switch, for example, Max4535 (having a voltage endurance of 36V) manufactured by Maxim CO. or the like can be used.

Thereby, in step 1, a pulse voltage at ±32V is stably applied to the ON pixels, a pulse voltage at ±24V is stably applied to the OFF pixels, and a pulse voltage at ±4V is applied to the pixels that are not selected.

In contrast, in step 2, a pulse voltage at ±24V is applied to the ON pixels, a pulse voltage at ±12V is applied to the OFF pixels, and a pulse voltage at ±4V or ±8V is applied to the pixels that are not selected.

Step 1 was executed at a scanning speed of about 2 ms/line. In step 2, the voltage applying period was about 2 ms in substep 1, the voltage applying period in substep 2 was about 1.5 ms, and the voltage applying period in substep 3 was about 1 ms, and the total scanning speed was 4.5 ms/line.

Under the above conditions, the insertion periods of the voltage zero levels (DSPOF) shown in FIG. 7B were 0.8 ms in total in step 1, 0.6 ms in substep 2, and 0.4 ms in substep 3.

In other words, the effective times of the voltage pulse were 1.2 ms in substep 1, 0.9 ms in substep 2, and 0.6 ms in substep 3.

Figure 17:
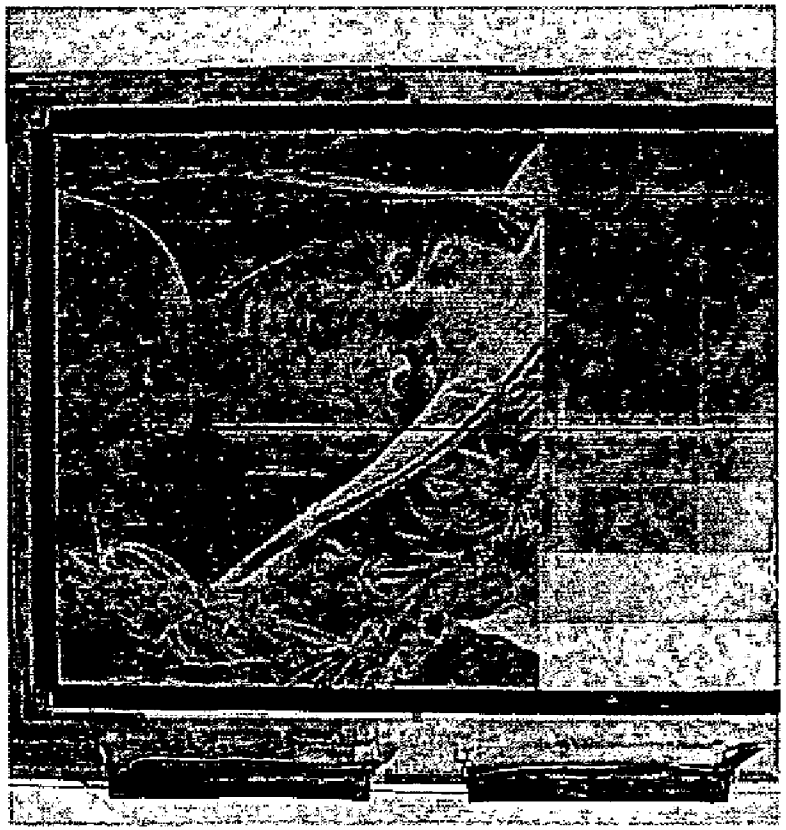
FIG. 17 shows a multilevel halftone display in an embodiment of the present invention.

The image data of 256 values to be input into the driver IC was converted into data of 8 values through a halftone transformation by using the error diffusion method. Thereafter, the data was further converted into the image data in substep 1 and substep 2 by the method shown in FIG. 12. By performing the driving on the above main conditions, a high quality display having a small graininess as shown in FIG. 17 was realized.

In order to demonstrate the above display quality level, a test image was displayed, and a comparison of graininess was performed with a conventional cholesteric liquid crystal display device. The display device according to the present invention and a conventional display device were caused to display step wedges from the white level to the black level, and the displayed step wedges were photographed. After they were photographed, the variations (root-mean-square deviation) of the reflectances with pixel values in the respective concentration patterns were calculated, and the result demonstrated that the graininess in the present invention was about half that of the conventional display device, which demonstrated the high display quality realized by the present invention. The comparison at the eight-level halftone was performed in this example experiment; however, the same level of display quality can be achieved at even a greater number of halftone levels, e.g., at a sixteen-level halftone or greater.

Further, as example experiment 2, an experiment is explained in which a display with 512 colors is realized by using color elements.

Three types of display elements (Red, Green, and Blue) of Q-VGA having the same configuration as that of the display element used in the above example experiment 1 were produced and layered in the order of Blue, Green, and Red. The driving circuit was set such that the respective colors were independently controlled. The above three display elements in the layered configuration were simultaneously driven in almost the same condition as in example experiment 1, and an excellent display with 512 colors was realized. Also, in this experiment, the timings of the DSPOF were offset as shown in FIG. 14 in order to reduce the spike current.

As described above, according to the present driving method, even when an inexpensive and general purpose driver that outputs binary values is used, a display with a multilevel halftone whose quality is much higher than the quality in conventional driving methods is realized when driving a display element that uses cholesteric liquid crystals, and the maximum contrast of liquid crystals can be realized.

Also, according to the present invention, it is possible to suppress to the minimum the number of overwriting iterations even when the number of halftone levels increases.

Further, because the driving process is divided into step 1 and step 2, the fundamental content of a full display content can be understood quickly in a similar manner to the progressive display method.

What is claimed is:

1. A method of driving a liquid crystal display element in which a driving voltage pulse is applied to a reflection material while selecting a scanning electrode in order from a plurality of scanning electrodes and a plurality of data electrodes facing one another, the scanning electrodes and data electrodes being arranged in such a manner that the scanning electrodes cross the data electrodes, the method comprising:

a step 1 in which respective pixels are caused to be in a reflecting state or in a non-reflecting state through a first scan; and a step 2 in which a prescribed pixel in a reflecting state and a prescribed pixel in a non-reflecting state are selected via a second scan and a reflectance of the prescribed pixel in the reflecting state is reduced and a reflectance of the pixel in the non-reflecting state is further reduced.

2. The method of driving a liquid crystal display element according to claim 1, wherein:

the step 2 comprises at least one substep for causing the respective pixels to have reflectances respectively corresponding to prescribed halftone levels.

3. The method of driving a liquid crystal display element according to claim 2, wherein:

in the step 2, a pixel group whose reflectance is scheduled to be reduced in a current substep is selected simultaneously from a pixel group selected in the step 1 or in a preceding substep and from a non-selected pixel group, and the reflectance scheduled to be reduced is reduced.

4. A method of driving a liquid crystal display element in which a driving voltage pulse is applied to a liquid crystal that forms a cholesteric phase while selecting a scanning electrode in order from a plurality of scanning electrodes and a plurality of data electrodes facing one another, the scanning electrodes and data electrodes being arranged in such a manner that the scanning electrodes cross the data electrodes, the method comprising:

a step 1 in which respective pixels are caused to be in a reflecting state or in a non-reflecting state through a first scan; and a step 2 in which a prescribed pixel in a reflecting state and a prescribed pixel in a non-reflecting state are selected via a second scan and a reflectance of the prescribed pixel in the reflecting state is reduced and a reflectance of the pixel in the non-reflecting state is further reduced.

5. The method of driving a liquid crystal display element according to claim 4, wherein:

the step 2 comprises at least one substep for causing the respective pixels to have reflectances respectively corresponding to prescribed halftone levels.

6. The method of driving a liquid crystal display element according to claim 5, wherein:

the reflecting state is a planar state or a state in which a planar state and a focal conic state are mixed, and the non-reflecting state is a focal conic state.

7. The method of driving a liquid crystal display element according to claim 6, wherein:

the step 2 comprises at least one substep of selecting a prescribed pixel in a reflecting state and a prescribed pixel in a non-reflecting state and reducing a reflectance of the pixel in the reflecting state and further reducing a reflectance of the pixel in the non-reflecting state in order to cause the respective pixels to have reflectances respectively corresponding to prescribed halftone levels.

8. The method of driving a liquid crystal display element according to claim 5, wherein:

in the step 2, a pixel group whose reflectance is scheduled to be reduced in a current substep is selected simultaneously from a pixel group selected in the step 1 or in a preceding substep and from a non-selected pixel group, and the reflectance scheduled to be reduced is reduced.

9. The method of driving a liquid crystal display element according to claim 5, wherein:

the step 1 comprises a step of resetting a liquid crystal to be in a homeotropic state or a focal conic state before forming an image.

10. The method of driving a liquid crystal display element according to claim 5, wherein:

the liquid crystal display element comprises unit to cause a voltage to be at a zero level before and after applying a pulse of an ON signal.

11. The method of driving a liquid crystal display element according to claim 5, wherein:

voltage levels that are applied to a liquid crystal forming the cholesteric phase are different from each other between the step 1 and the step 2.

12. The method of driving a liquid crystal display element according to claim 5, wherein:

pulse widths that drive a liquid crystal that forms the cholesteric phase are different from one another in each of the respective substeps in the step 2.

13. The method of driving a liquid crystal display element according to claim 5, wherein:

the substeps are executed on one line that is being scanned.

14. The method of driving a liquid crystal display element according to claim 5, wherein:

a display element is configured by layering a plurality of elements;

the respective layers are driven by voltage pulses that are independent from one another;

each of the plurality of elements has means for causing a voltage to be at a zero level before and after applying a pulse for each ON signal in order to offset timings of applying pulses for the respective ON signals.

15. The method of driving a liquid crystal display element according to claim 5, wherein:

in the step 1, an output at an ON level is used for causing the respective pixels to be in a reflecting state and an output at an OFF level is used for causing the respective pixels to be in a non-reflecting state by using a binary output driver IC for STN.

16. The method of driving a liquid crystal display element according to claim 5, wherein:

in the step 2, an output at an ON level is used for reducing a reflectance and an output at an OFF level is used for maintaining a state by using a binary output driver IC for STN.

17. The method of driving a liquid crystal display element according to claim 5, wherein:

display data used for driving in each step is obtained by dividing and converting image data that is obtained by a halftone transformation from a piece of original image data.

18. The method of driving a liquid crystal display element according to claim 5, wherein:

a driving voltage is equal to or lower than 40V.

19. A liquid crystal display element in which a driving voltage pulse is applied to a reflection material while selecting a scanning electrode in order from a plurality of scanning electrodes and a plurality of data electrodes facing one another, the scanning electrodes and data electrodes being arranged in such a manner that the scanning electrodes cross the data electrodes in order to display an image, the liquid crystal display element comprising:

first means causing respective pixels to be in a reflecting state or in a non-reflecting state through a first scan; and second means selecting a prescribed pixel in a reflecting state and a pixel in a non-reflecting state through a next scan, reducing a reflectance of the prescribed pixel in a reflecting state, and further reducing a reflectance of the pixel in a non-reflecting state.

20. A liquid crystal display element in which a driving voltage pulse is applied to a liquid crystal that forms a cholesteric phase while selecting a scanning electrode in order from a plurality of scanning electrodes and a plurality of data electrodes facing one another, the scanning electrodes and data electrodes being arranged in such a manner that the scanning electrodes cross the data electrodes in order to display an image, the liquid crystal display element comprising:

first means causing respective pixels to be in a reflecting state or in a non-reflecting state through a first scan; and second means selecting a prescribed pixel in a reflecting state and a pixel in a non-reflecting state through a next scan, reducing a reflectance of the prescribed pixel in a reflecting state, and further reducing a reflectance of the pixel in a non-reflecting state.

* * * * *